United States Patent [19]

Corben et al.

[11] 4,339,532

[45] Jul. 13, 1982

[54] NOVEL PHOTOSENSITIVE SILVER HALIDE EMULSION AND METHOD OF PREPARING SAME

[75] Inventors: Leo D. Corben, Swampscott; Martin L. Falxa, Cambridge, both of Mass.

[73] Assignee: Polaroid Corporation, Cambridge, Mass.

[21] Appl. No.: 223,478

[22] Filed: Jan. 8, 1981

[51] Int. Cl.[3] ..... G03C 1/02

[52] U.S. Cl. ..... 430/567; 430/569

[58] Field of Search ..... 430/569, 567

[56] References Cited

U.S. PATENT DOCUMENTS

| | | | |
|---|---|---|---|
| 3,031,304 | 4/1962 | Oliver | 430/569 |
| 3,206,313 | 9/1965 | Porter et al. | 96/94 |
| 3,317,322 | 5/1967 | Porter et al. | 96/108 |
| 3,622,318 | 11/1971 | Evans | 96/22 |
| 4,046,576 | 9/1977 | Terwilliger et al. | 430/569 |
| 4,063,951 | 12/1977 | Bogg | 430/569 |
| 4,067,739 | 1/1978 | Lewis | 430/569 |
| 4,242,445 | 12/1980 | Saito | 430/569 |
| 4,251,627 | 2/1981 | Calamur | 430/569 |
| 4,264,724 | 4/1981 | Moisar et al. | 430/569 |

FOREIGN PATENT DOCUMENTS 1027146 4/1966 United Kingdom .

*Primary Examiner*—Mary F. Downey
*Attorney, Agent, or Firm*—Philip G. Kiely

[57] ABSTRACT

Monodisperse, negative working photosensitive silver halide emulsions comprising grains having a uniform habit and relatively high degree of crystal disorder are prepared by precipitating silver halide in the presence of a seed emulsion which is predominantly silver chloride under conditions whereby substantially none of the silver chloride of said seed emulsion is redissolved and substantially no additional grains are formed.

17 Claims, 26 Drawing Figures

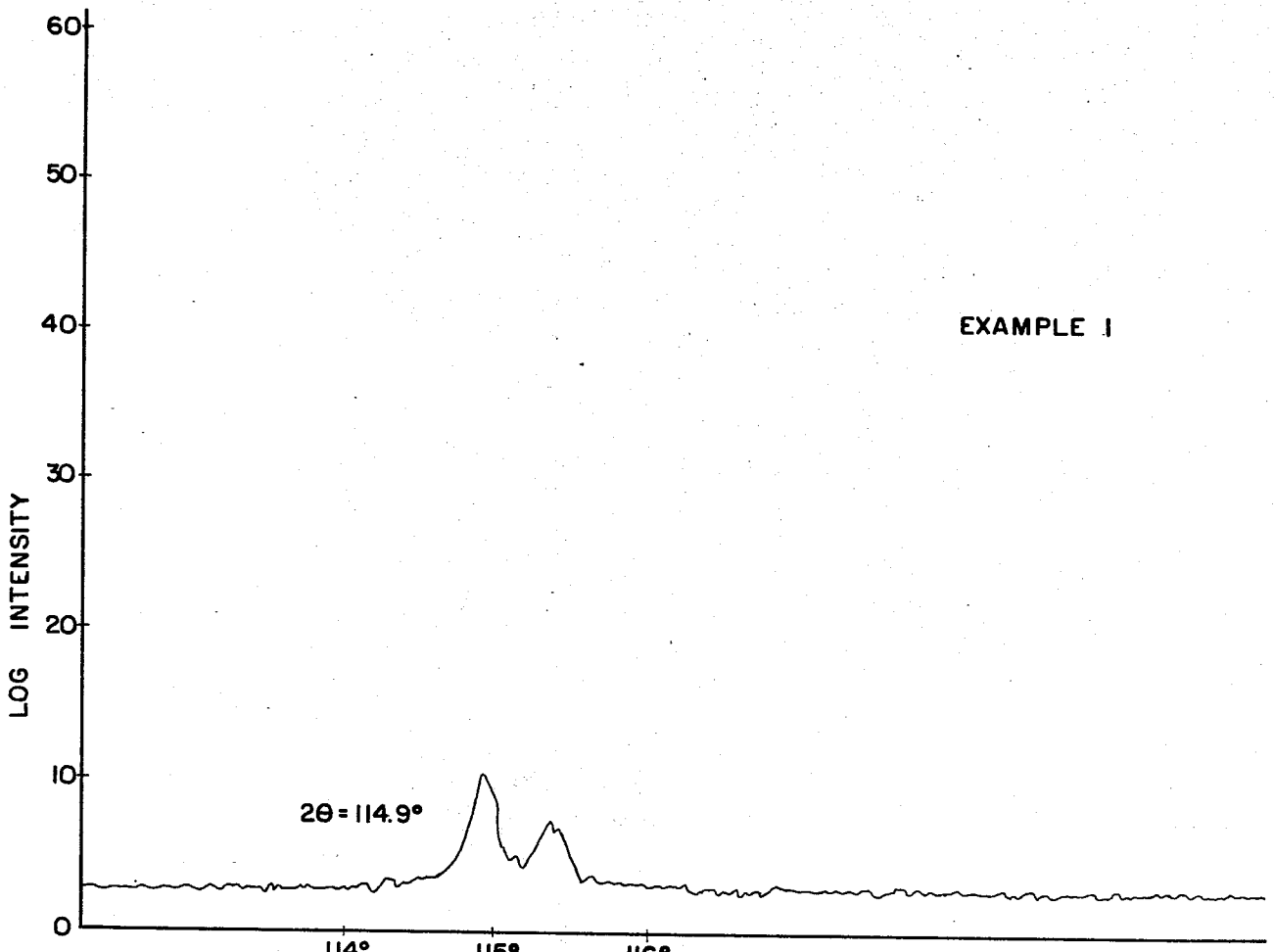
FIG. I

NOVEL PHOTOSENSITIVE SILVER HALIDE EMULSION AND METHOD OF PREPARING SAME

BACKGROUND OF THE INVENTION

Silver halide emulsions containing silver halide grains wherein a grain of an initial halide composition is formed and then overcoated with one or more other halides are known to the art. Such emulsions are disclosed in the patents set forth below.

U.S. Pat. No. 3,317,322 discloses silver halide grains having high internal sensitivity; said grains comprising a central core of chemically sensitized silver halide and an outer shell of silver halide which is chemically sensitized subsequent to the formation of the outer shell.

U.S. Pat. No. 3,206,313 discloses silver halide grains having high internal sensitivity; said grains comprising a central core of chemically sensitized silver halide and an outer shell of silver halide wherein the outer shell may or may not be chemically sensitized.

British Pat. No. 1,027,146, published Apr. 27, 1966, is directed to a method for forming direct positive emulsions comprising composite silver halide grains having a narrow particle size distribution composed of a core and one or more contiguous layers which differ from each other in composition. The emulsions are prepared by forming silver bromide nuclei by a double jet method which comprises adding silver nitrate and an alkali metal halide to a solution of gelatin at a pAg between 6 and 10. The surface of the thus-formed nuclei grains is then sensitized by physical or chemical modification of the grain surface. The thus-sensitized nuclei are then provided with one or more layers of silver halide by carrying out silver halide precipitation at a pAg of about 9 or more. Although the examples only show silver bromide as the siliver halide nuclei it is also stated that other silver halides, such as silver chloride could also be employed.

The initially formed grains can also be modified by the method set forth in U.S. Pat. No. 3,622,318, for example, which discloses so-called "converted halide silver grains" which identify silver halide grains formed at least partly of a silver salt more soluble than silver bromide and converting at least a portion of the grains to silver bromide or silver iodobromide.

SUMMARY OF THE INVENTION

The present invention is directed to a monodisperse, negative-working silver halide emulsion wherein the grains possess a relatively high level of internal disorder in the crystal structure and uniform habit and which contain silver chlorobromide or silver chloroiodobromide.

The grains of the novel emulsions of the present invention are formed by precipitating silver halide in the presence of a monodisperse silver chloride seed emulsion having a cubic habit under conditions wherein substantially none of said silver chloride seed is redissolved and substantially no additional grains are formed. The resulting grains are also monodisperse.

The term "monodisperse", as used herein is intended to refer to a silver halide emulsion having a volume weighted grain size coefficient of variation (volume weighted diameter standard deviation divided by mean volume weighted diameter) of about 20% or less, preferably about 15% or less, as determined by Coulter Counter.

BRIEF DESCRIPTION OF THE DRAWINGS

FIG. 1 is a x-ray diffraction trace of the grains prepared in Example 1;

DETAILED DESCRIPTION OF THE INVENTION

For convenience, a number of sensitometric terms employed in the description of the present invention are defined herewith. The definitions should be considered in conjunction with the model H and D curve for a color diffusion transfer reflection print in FIG. 17.

---

$D_{max}$ — The maximum dye density obtained on a processed film unit without any -continued

Figure 17:
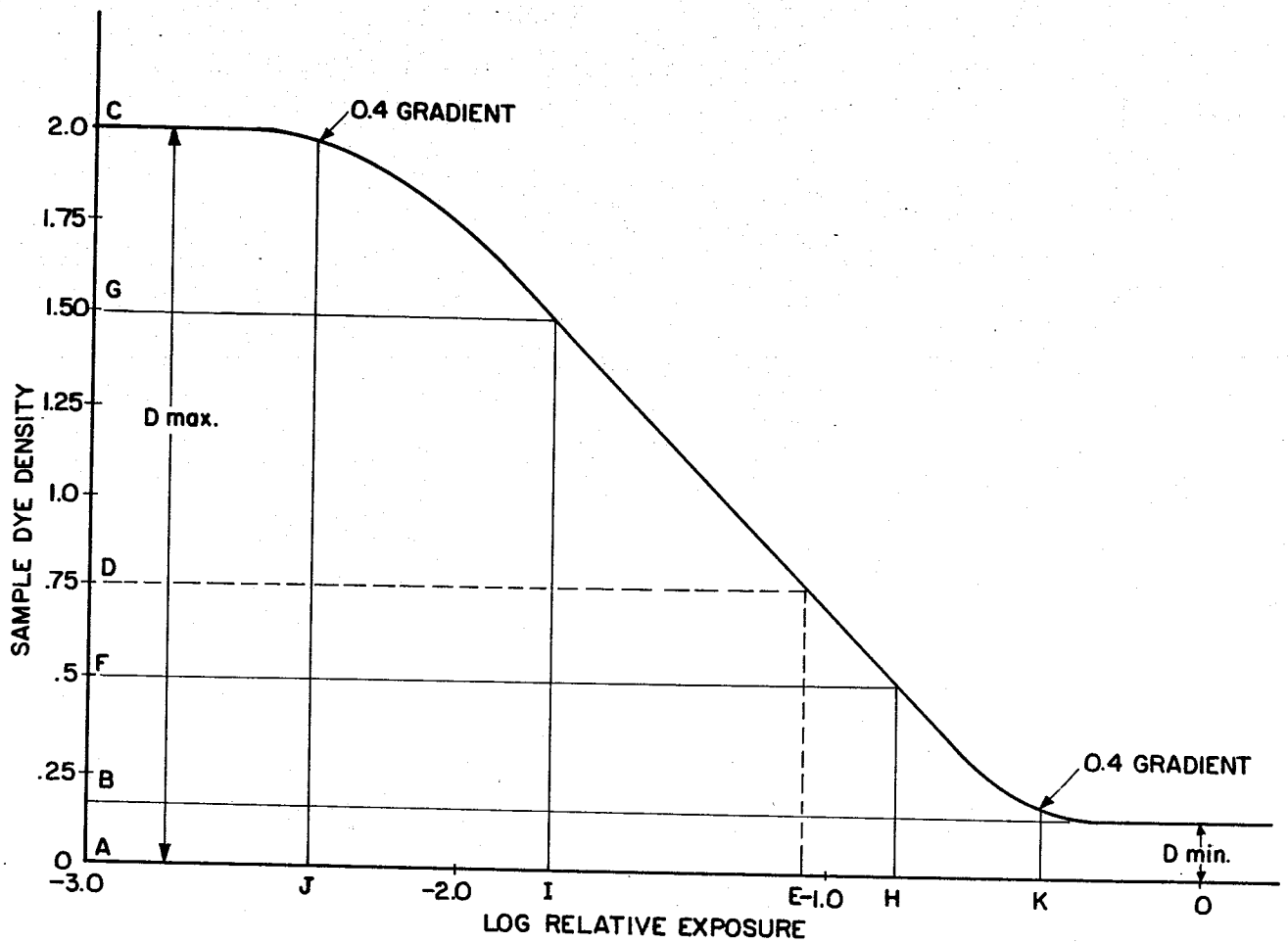
FIG. 17 is a model H and D curve.

| | |
|---|---|
| | exposure (height A − C in FIG. 17). |
| $D_{min}$ | The minimum dye density obtained on a processed film unit with full exposure (height A − B in FIG. 17). |
| Toe Speed | The log exposure value obtained on a processed film unit at the 0.75 sample density intercept (log exposure E in FIG. 17) |
| Shoulder Speed | The value of the lowest exposure (log exposure) that produces a sensitometric slope of 0.40 (log exposure J in FIG. 17) |
| Slope | The slope of the sensitometric curve obtained by dividing the single dye density difference between $\frac{1}{4}$ and $\frac{3}{4}$ of $D_{max}$ by the log exposure difference for these two points $\left(\frac{\Delta \text{ sample dye density}}{\Delta \text{ log exposure}} = \frac{(G-F)}{(J-E)} = \text{Slope in FIG. 17}\right)$ |
| Dynamic Range | The antilogrithm of the differences between the 0.4 log exposure gradients at the highest and lowest exposures (antilog of J − H in FIG. 17). |

It is recognized in the art that monodisperse silver halide emulsions generally exhibit excessively high slopes, relatively slow shoulder speed and possess a high degree of crystal order. The novel monodisperse emulsions of the present invention, however, do not exhibit the above-mentioned generally found high slopes, possess a relatively high degree of crystal disorder and show enhanced shoulder speed without loss of control of diffusible dye-image forming material in diffusion transfer processes.

Thus, it is believed that the employment of the novel silver halide emulsions in film units of the type described above modify the dye diffusion control aspects of the dye transfer process to provide the type of dye image acuity and resolution generally provided by monodisperse emulsions in combination with the type of shoulder speed and curve shape generally provided by polydisperse emulsions.

The novel silver halide emulsions are negative-working, monodisperse silver chlorobromide or silver chloroiodobromide emulsions possessing a relatively high degree of crystal disorder and a uniform crystal habit, as determined by peak broadening of the x-ray diffraction trace. It is also believed that the peak broadening of x-ray diffraction trace may indicate that the halides are distributed throughout the grain in a non-uniform manner. Even though the emulsion is formed using a seed emulsion, which is predominantly silver chloride, and a substantial amount of the silver chloride is retained in the grain, there is no detectable sharp boundry between the seed grain and the silver halide subsequently precipitated in the presence of said seed grains. In other words, the emulsions of the present invention are not layered or so-called core-shell emulsions.

The seed silver chloride emulsion is preferably prepared by precipitating silver chloride from silver nitrate and an alkali or ammonium chloride under conditions which provide an excess of silver ions, i.e., at a controlled pAg of about 2.5 to 6 and a pH of less than about 7. In a preferred embodiment the precipitation is carried out at a pAg of about 4 and a pH of about 5.6

It is necessary that the silver chloride seed not be prepared at a pAg of above about 2.5 to avoid reduction sensitization. At a pH above 7 reduction sensitization may occur.

In a preferred embodiment, the seed emulsion is not removed from the vessel in which it is formed. The second precipitation can follow the formation of the seed emulsion preparation almost immediately and without washing. In fact, it is believed that additional speed is obtained if the seed emulsion is not washed prior to the second stage precipitation.

In an alternative embodiment, the silver chloride seed emulsion is prepared in the presence of radiation actinic to said silver chloride. A further increase in speed may be obtained employing a seed silver chloride emulsion prepared in this manner.

In the second stage precipitation, silver nitrate and water-soluble halide salts are added by a double jet procedure under pAg conditions which do not permit substantial redissolving of the silver chloride seed emulsion; i.e. between about 2.5 and about 10.5. Preferably, precipitation is carried out at a pAg of about 7 to 9. The initially-formed seed grain grows to provide the desired grain size while the halides are being redistributed in the grain during grain growth. The aforementioned crystal disorder is introduced during this stage.

During the second stage precipitation, there may be some slight loss of chloride ion from the grain but substantially no seed grains are dissolved nor are new grains formed.

It should be understood, however, that there also may be some slight loss of chloride from the grain during floccing or ultrafiltration of the emulsion if these steps are carried out in the presence of bromide ion.

It should be noted that a seed emulsion other than predominantly silver chloride, e.g., silver bromide, does not provide grains possessing the disorder obtained by the method of the present invention. Such emulsions prepared with seeds other than silver chloride exhibit properties found in conventional monodispersed emulsions such as high slopes and low shoulder speeds.

The enhanced shoulder speed found in the emulsions of the present invention is believed to be obtained by the crystal disorder in the grains and non-uniform halide distribution produced by the novel method of the present invention. It is believed that the disorder is provided by the rearrangement of the chloride of the seed grains during the subsequent precipitation of the silver bromide or silver iodobromide. The aforementioned rearrangement is not accomplished by redissolving and reprecipitating of the silver halide but rather by a solid state rearrangement. Thus, by means of the present invention an unstable crystal condition is produced. Care must be taken subsequent to grain formation to prevent annealing which would result in the loss of disorder in the grain or which would permit the chloride to exchange with bromide or iodide in the environment surrounding the grain. Thus, the emulsion should not be subjected to temperatures above those which would maintain the emulsion in the solid state for any appreciable length of time to avoid annealing. After washing and during extended storage, the emulsion should be maintained in an appropriate chlorobromide environment as determined by the chloride content of the grain and temperature at which it is held to prevent chloride loss from the grain.

The crystal disorder is measured by x-ray diffraction examination of the grain. The relative internal disorder in the silver halide grains is measured by the amount of peak broadening in the x-ray diffraction traces. Thus, an x-ray diffraction trace for pure silver chloride would show a distinct peak at about 5.549 Å and, for pure silver bromide at about 5.775 Å. A core-shell emulsion, would be expected to show an x-ray diffraction trace with two distinct sets of peaks; one doublet for the halide in the core and one doublet for the halide in the shell. In the present invention, however, no separate peaks for the individual silver halides are found, but analysis shows a substantial amount of chloride is in the crystal.

The crystal disorder of the grains of the present invention can be quantified by measuring the amount of peak broadening of the x-ray diffraction traces. By plotting $\beta \cos \theta$ vs $2 \sin \theta$, where $\beta$ is the breadth of the peak (at half-height) at the Bragg angle $\theta$, a straight line with a slope proportional to internal disorder is obtained. Emulsions of the present invention have a crystal disorder as measured by a $\beta \cos \theta$ vs $2 \sin \theta$ slope plot equal to or greater than 2 times the slope for a pure silver bromide crystal.

For additional details on x-ray diffraction examination of crystals and determination by Bragg angle, see for example, *Elements of X-Ray Diffraction* by B. D. Cullity, 1st Edition, Addison-Wesly, Reading, Mass., (1956) Chapter 9.

Preparation of the emulsions for x-ray diffraction examination was carried out by separating and cleansing the silver halide grains with enzymes, centrifuging and washing the grains and collecting them on a filter surface.

As stated above, the seed emulsion is at least 51% silver chloride and may include other halides. Preferably, the seed is 100% silver chloride. Thus, the composition of the seed grain may comprise 51 to 100% chloride, 0 to 49% bromide and 0 to 49% iodide. Any combination of halides may be precipitated on the seed grains during the second stage precipitation and preferably comprises 75 to 100% bromide, 0 to 20% chloride and 0 to 20% iodide. The chloride precipitated on the seed grains must be less than the chloride content of the seed grain. It is preferred that the second stage precpitation contain iodide, and more iodide than the seed grains in order to provide the dye diffusion control referred to above. It can be readily seen that, within the parameters specified, the sequence of addition and content of each halide can be varied over a relatively wide range.

The halide content of the finished grains depends to some degree on the size of the grains and the ratios of halides precipitated during the second stage. For example, the larger the grain is, the lower the chloride content, assuming that no chloride is precipitated in the second stage. In a preferred embodiment, the finished grains contain about 60–95% Br; 1–40% Cl and 0–20% I.

Emulsions of the present invention are particularly suitable for use in photographic film units which comprise at least a first photosensitive silver halide emulsion layer having associated therewith a dye image-forming material, preferably a dye developer which is soluble and diffusible in alkali as a function of the exposure and development of the silver halide emulsion layer, and a polymeric layer dyeable by said dye image-providing material wherein said dyeable polymeric layer is at least in superposed relationship with said photosensitive element after exposure of said element and during processing of the exposed photosensitive silver halide emulsion, that is, during contact of said emulsion with the aqueous alkaline processing composition.

Film units and processes of the present invention may be conveniently described with respect to dye developers although it will be understood that other forms of dye image-forming materials may be employed in the present invention. The emulsions of the present invention are also suitable for use in black and white film units and conventional color and black and white tray development.

A dye developer which is well known in the art and which acts as both a developer and as an image-forming dye is associated with its appropriate silver halide emulsion; for example, a cyan dye developer associated with a red-sensitive silver halide layer; a magenta dye developer associated with a green-sensitive silver halide emulsion layer; and a yellow dye developer associated with a blue-sensitive silver halide emulsion layer. Before oxidation, the dye developer would be insoluble in water but soluble in aqueous alkali. A dye developer undergoing oxidation as a result of development of exposed silver halide would be immobilized and the remaining unoxidized dye developer would diffuse to the dyeable image-receiving layer producing a positive image therein.

To provide rapid transfer of unoxidized dye developer and to minimize unwanted interactions in the negative, it is preferred that the unoxidized dye developer pass through the associated silver halide emulsion layer as rapidly as possible. Therefore, the silver halide should be rapidly developable to immobilize the dye developer in exposed areas before it passes through the controlling emulsion layer.

The following non-limiting examples illustrate the present invention. In the following examples, where the emulsions were prepared in white light, the white light intensity was measured with a Techtronix J-16 digital photometer using a J-6502 probe. The grain habit was ascertained by electron microscopy and volume weighted diameter (mean volume diameter, MVD) by Coulter Counter. In all examples, Solution 2 was regulated to maintain the indicated pAg set point. The x-ray diffraction traces shown in the following examples indicate the typical peak placement and width but they may show different diffraction angles as described by Miller indices (h, x, l).

EXAMPLE 1 (CONTROL)

Silver bromide conventional monodisperse emulsion

| | |
|---|---|
| Solution 1 | 3N silver nitrate in distilled water |
| Solution 2 | 3N potassium bormide in distilled water |

Figure 1A:
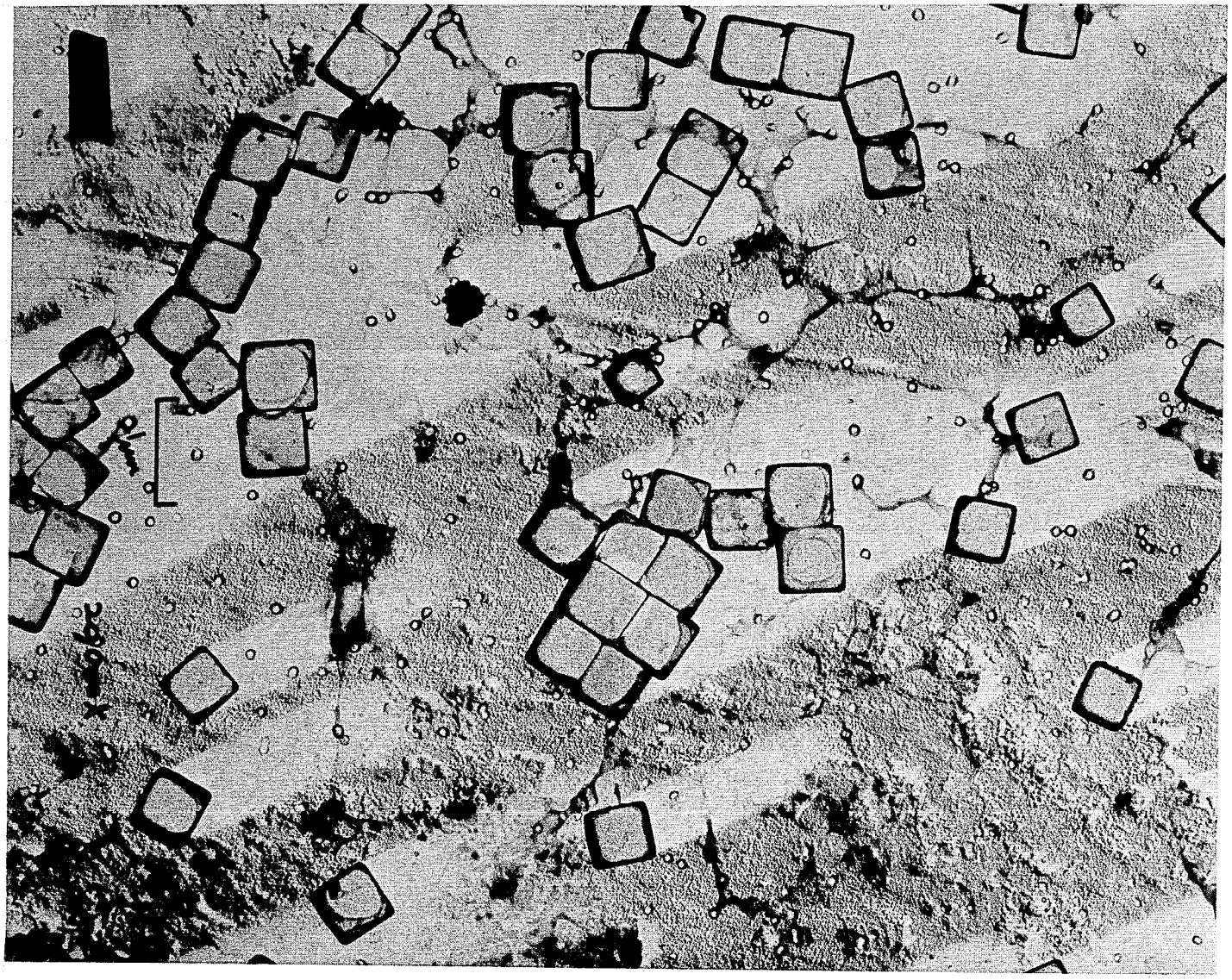
FIG. 1A is an electron micrograph of the emulsion prepared in Example 1.

Solutions 1 and 2 were simultaneously jetted into an agitated 2 liter aqueous solution containing 54 g of photographically inert gelatin with a concentration of 0.1% ammonium hydroxide at a pAg set point of 7.0, a pH of about 5.6, and a temperature of 42° C. Solution 1 was added for 105 minutes at an average flow rate of 44 g/min to produce a silver bromide crystal with a MVD of about 0.79 μm. The emulsion was washed, additional gelatin added to produce a gelatin/silver ratio of 0.5 and the emulsion was chill set at 20° C. FIG. 1 is the x-ray diffraction trace of the grains prepared in Example 1. The cubic habit was ascertained by electron microscopy as shown in FIG. 1A.

EXAMPLE 2 (CONTROL)

Silver chlorobromide conventional monodisperse emulsion

| | |
|---|---|
| Solution 1 | 3N silver nitrate in distilled water |
| Solution 2 | 3N potassium halides (15% KCl, 85% KBr) in distilled water |

Figure 2:
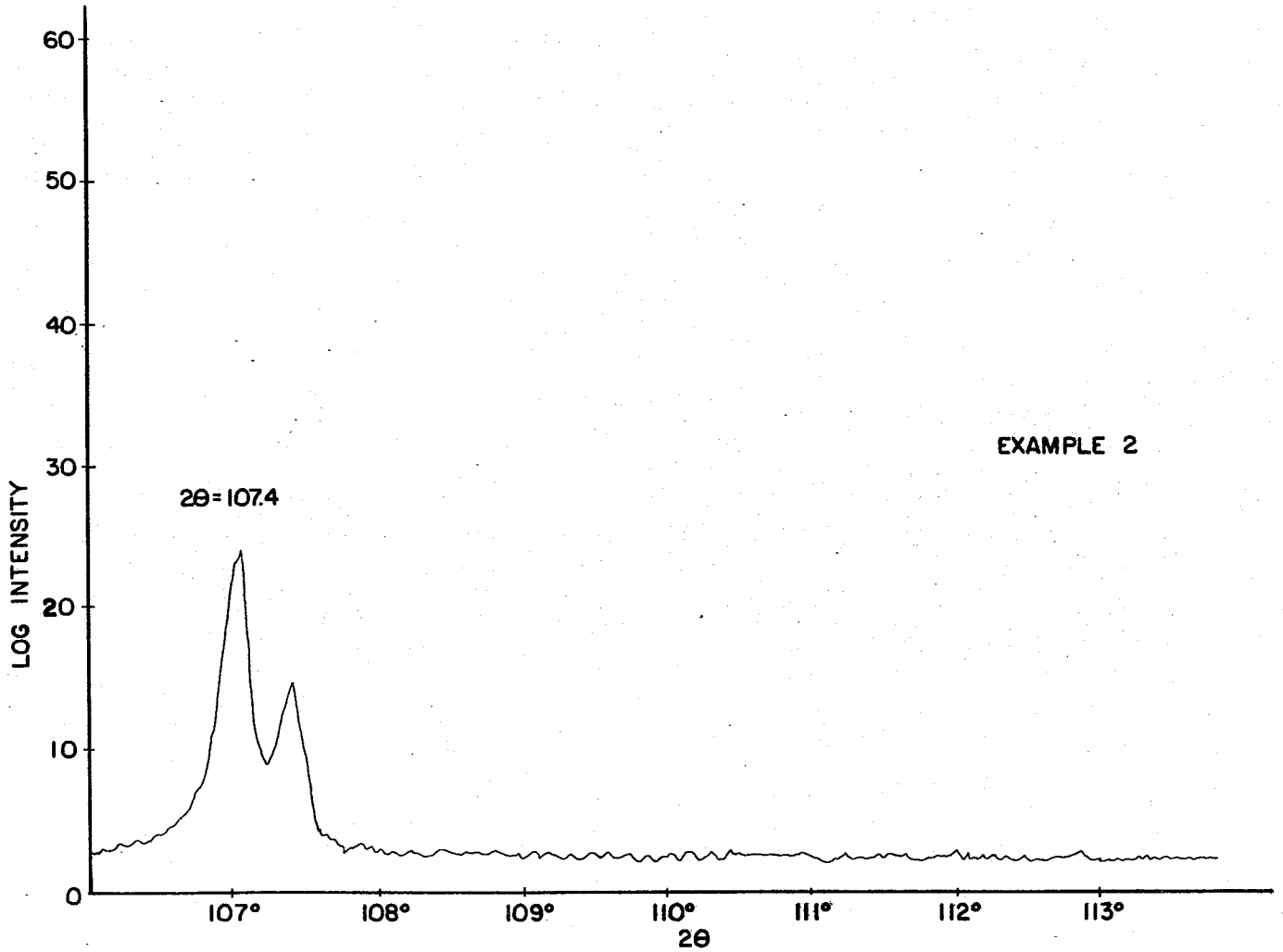
FIG. 2 is an x-ray diffraction trace of the grains prepared in Example 2.
Figure 2A:
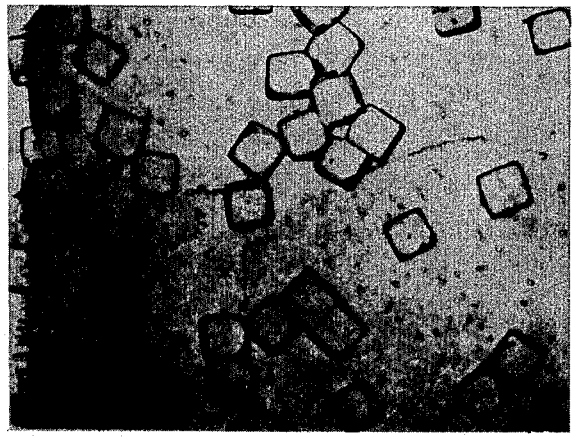
FIG. 2A is an electron micrograph of the emulsion prepared in Example 2.

Solutions 1 and 2 were simultaneously jetted into an agitated 2 liter aqueous solution containing 51 g of photographically inert gelatin at a pAg set point of 4, a pH of about 5.6 and a temperature of 42° C. Solution 1 was added for 366 minutes at an average flow rate of 13 g/min to form a silver chlorobromide crystal with a MVD of about 0.98 μm. The emulsion was washed; additional gelatin added to produce a gelatin/silver ratio of 0.5 and the emulsion was chill set at 20° C. FIG. 2 is the x-ray diffraction trace of the grains prepared in Example 2. The cubic crystal habit was ascertained by electron microscopy as shown in FIG. 2A.

| | Cl/Br |
|---|---|
| Aim composition | 15/85 |
| Wet chemical analysis | 11/89 |
| X-ray diffraction | 13/87 |

EXAMPLE 3

Silver chloride monodisperse seed emulsion (illuminated during precipitation)

| | |
|---|---|
| Solution 1 | 1N silver nitrate in distilled water |
| Solution 2 | 1N potassium chloride in distilled water |

Figure 3:
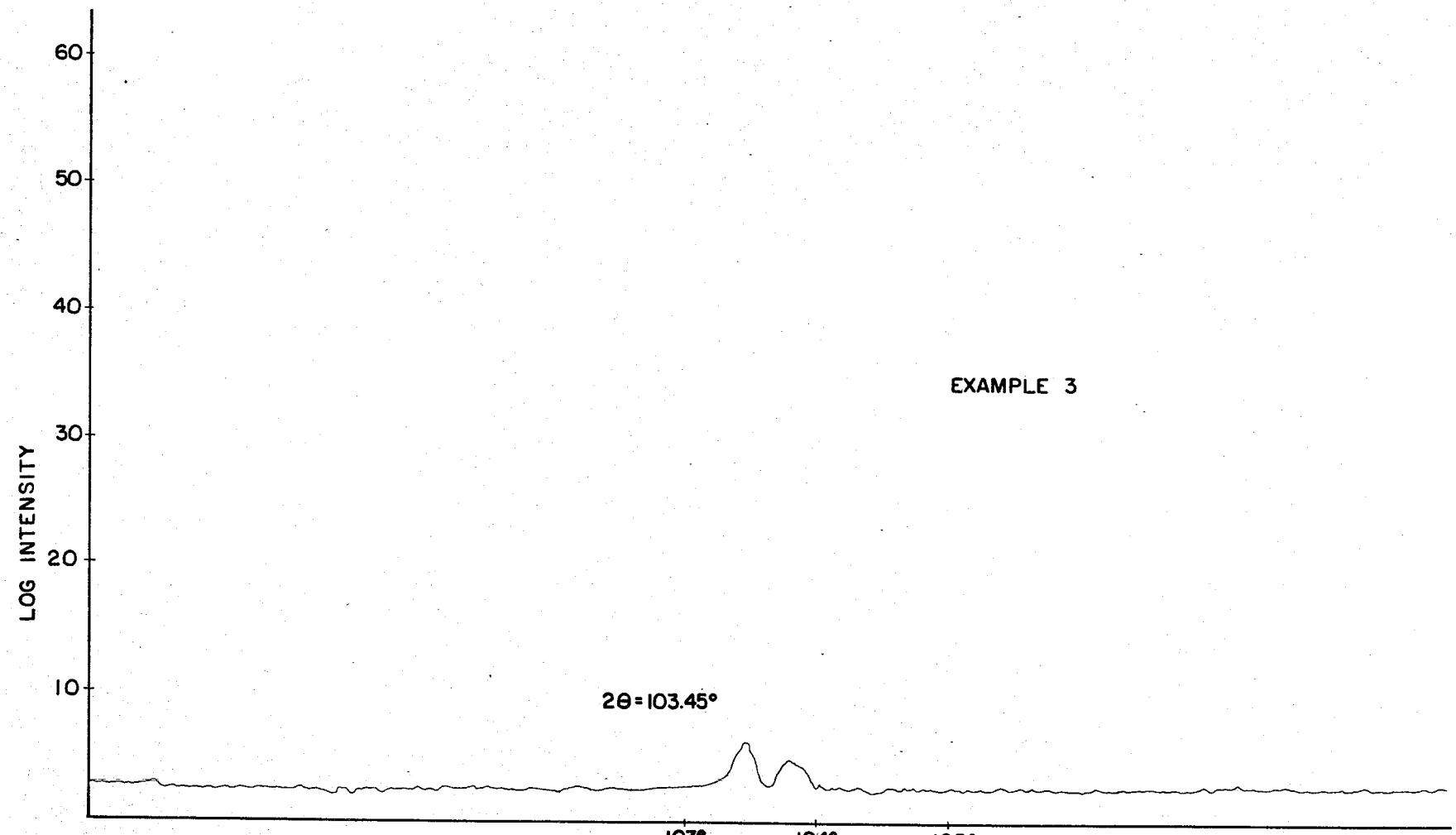
FIG. 3 is an x-ray diffraction trace of the grains prepared in Example 3.
Figure 3A:
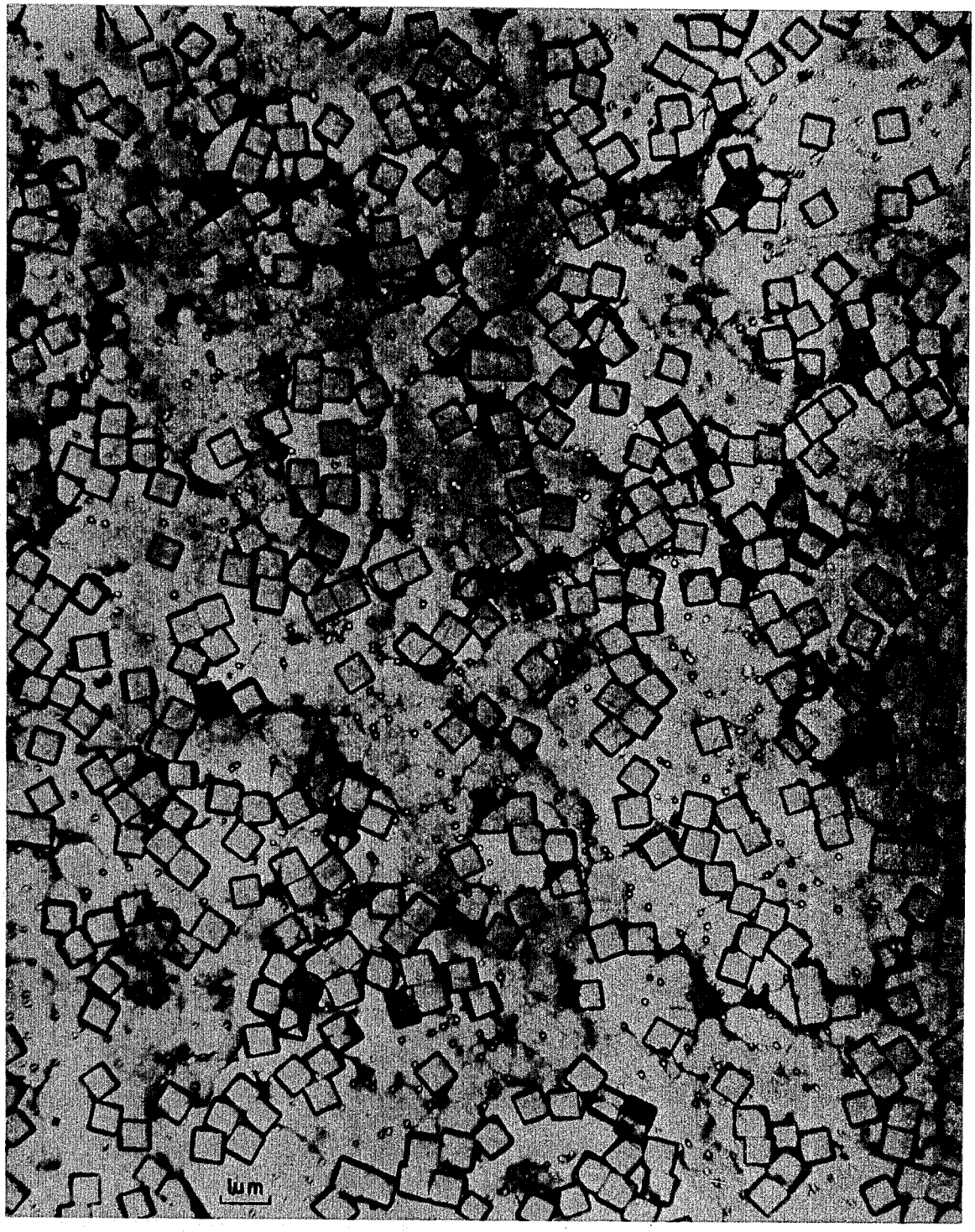
FIG. 3A is an electron micrograph of the emulsion prepared in Example 3.

Solutions 1 and 2 were simultaneously jetted into an agitated aqueous solution of 20 liters containing 405 g of photographically inert gelatin at a temperature of 42° C. at a pAg set point of 4 and a pH of about 5.6 under white light conditions. The light was left on during the entire jetting time of 570 minutes. The irradiation was about 80 μwatts/cm$^2$ over a surface area of 720 cm$^2$ with a 150 watt Sylvania EXCEL LINE incandescent bulb. Solution 1 was jetted for 570 minutes at an average flow rate of 55 g/min to form a silver chloride emulsion with a MVD of about 0.78 μm. The emulsion was washed; additional gelatin added to produce a gelatin/silver ratio of 0.5 and the emulsion was chill set at 20° C. FIG. 3 is the x-ray diffraction trace of the grains prepared in Example 3. The cubic habit was ascertained by electron microscopy as shown in FIG. 3A.

EXAMPLE 4

Silver chloride monodisperse seed emulsion

| | |
|---|---|
| Solution 1 | 3N silver nitrate in distilled water |
| Solution 2 | 3N potassium chloride in distilled water |

Figure 4:
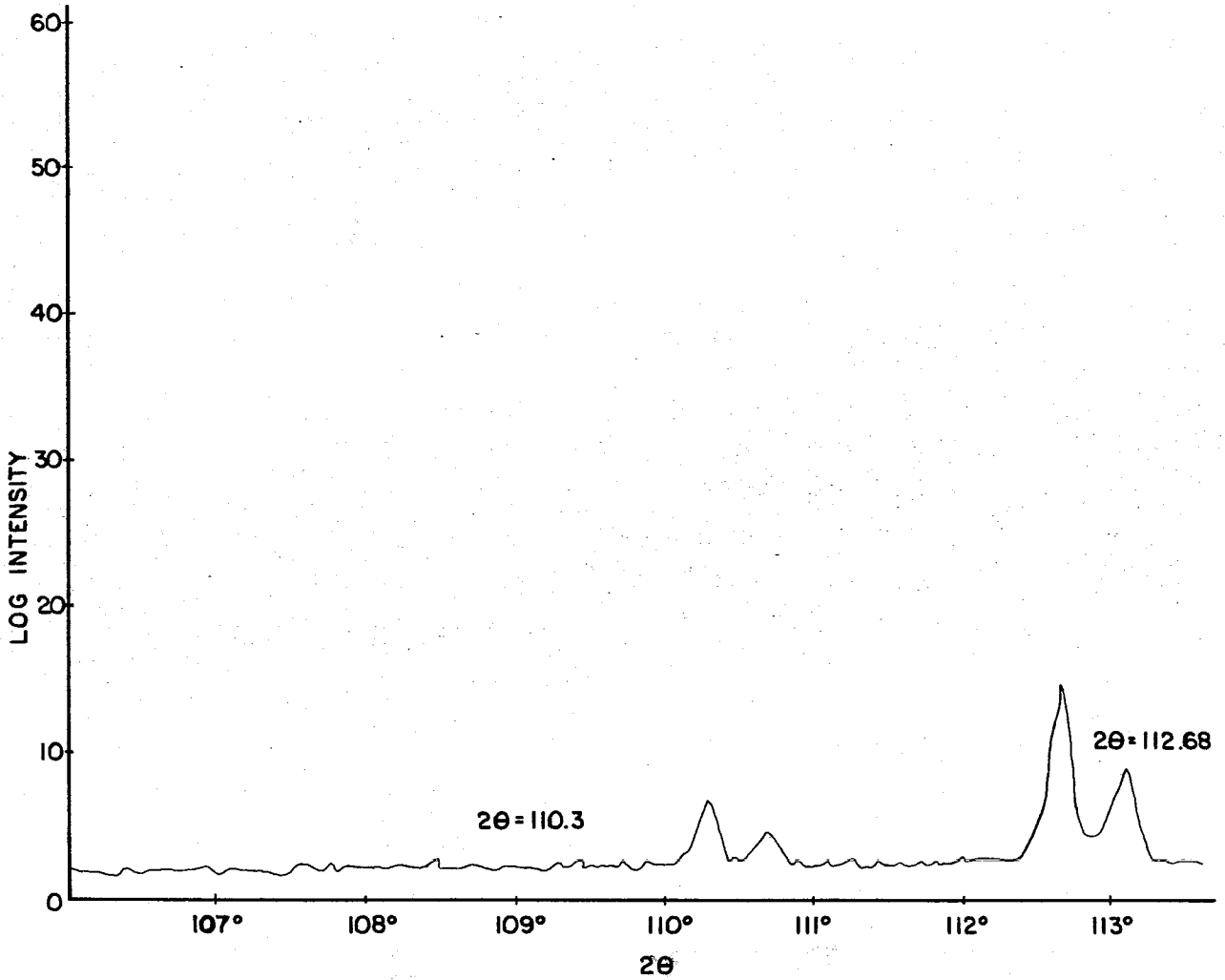
FIG. 4 is an x-ray diffraction trace of the grains prepared in Example 4.
Figure 4A:
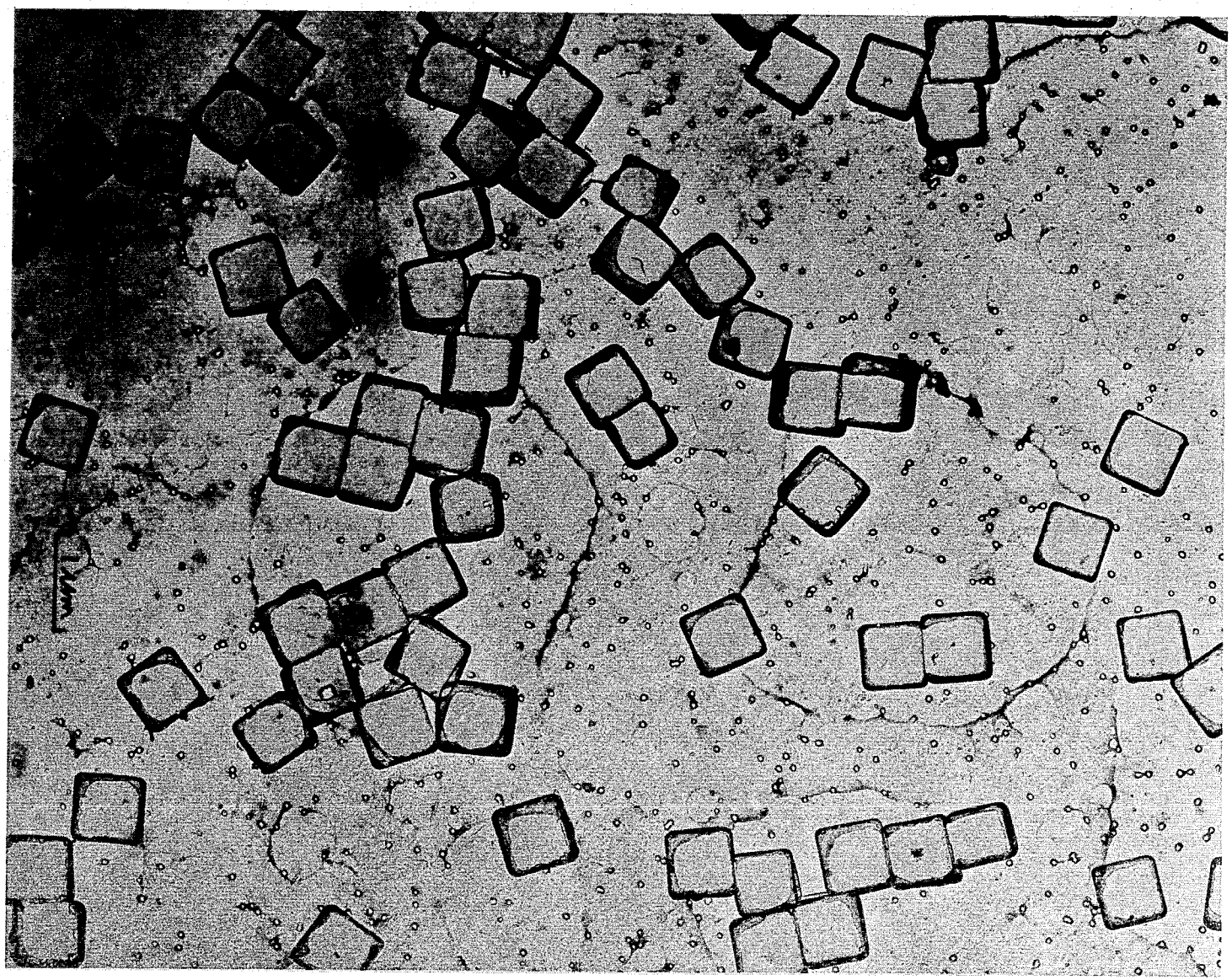
FIG. 4A is an electron micrograph of the emulsion prepared in Example 4.

Solutions 1 and 2 were simultaneously jetted into an agitated aqueous solution of 2 liters containing 52 g of photographically inert gelatin at a pAg set point of 4.0, a pH of about 5.6 and a temperature of 42° C. in the dark. Solution 1 was jetted for 411 minutes at an average flow rate of 43 g/min to form a silver chloride crystal with a MVD of about 0.79 μm. The emulsion was washed; additional gelatin was added to produce a gelatin/silver ratio of 0.5 and the emulsion was chill set at 20° C. FIG. 4 is the x-ray diffraction trace of the grains prepared in Example 4. The cubic habit was ascertained by electron microscopy as shown in FIG. 4A.

EXAMPLE 5

Silver chlorobromide high disorder minodisperse emulsion

| | |
|---|---|
| Solution 1 | 3N silver nitrate in distilled water |
| Solution 2 | 3N potassium bormide in distilled water |

Figure 5:
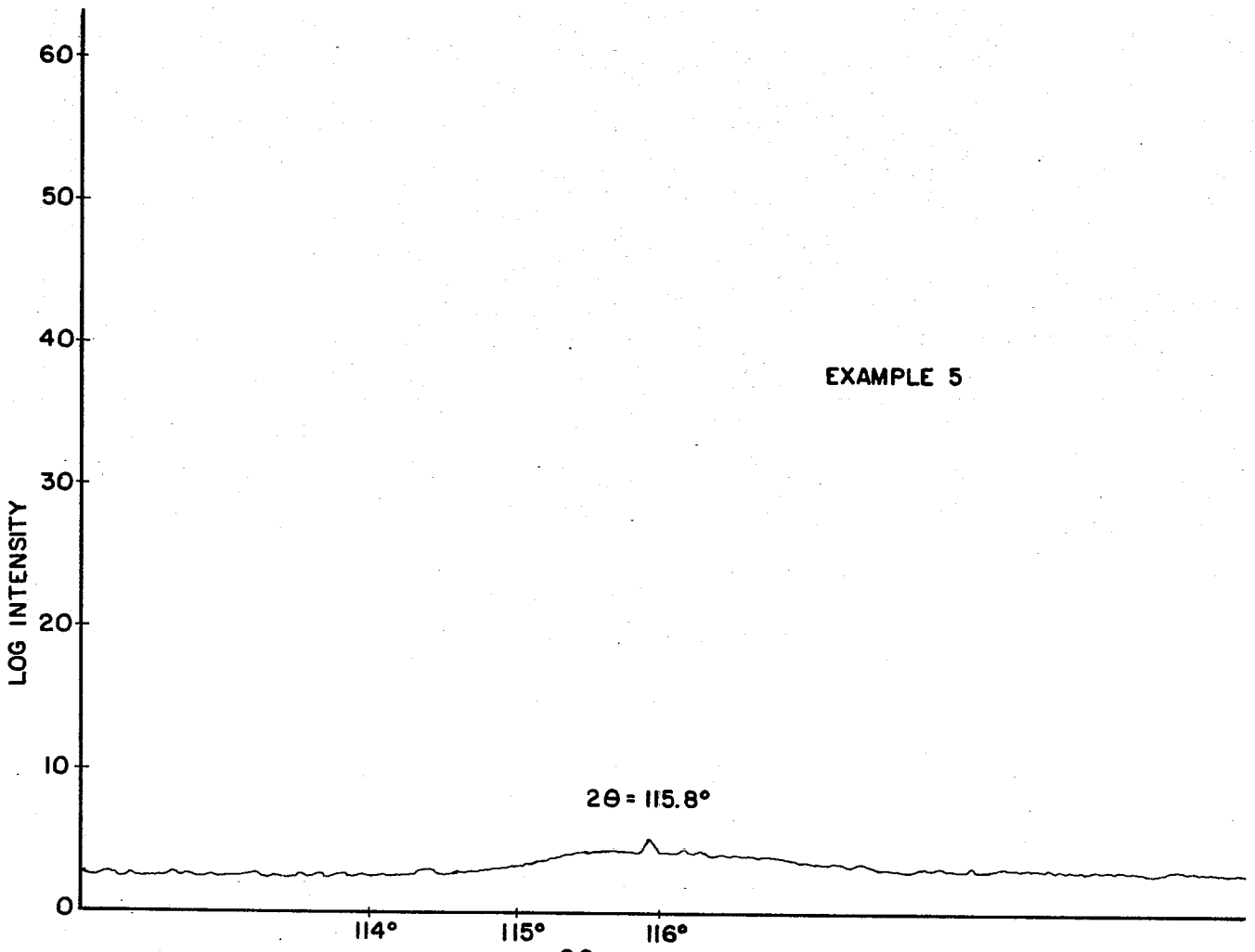
FIG. 5 is an x-ray diffraction trace of the grains prepared in Example 5.
Figure 5A:
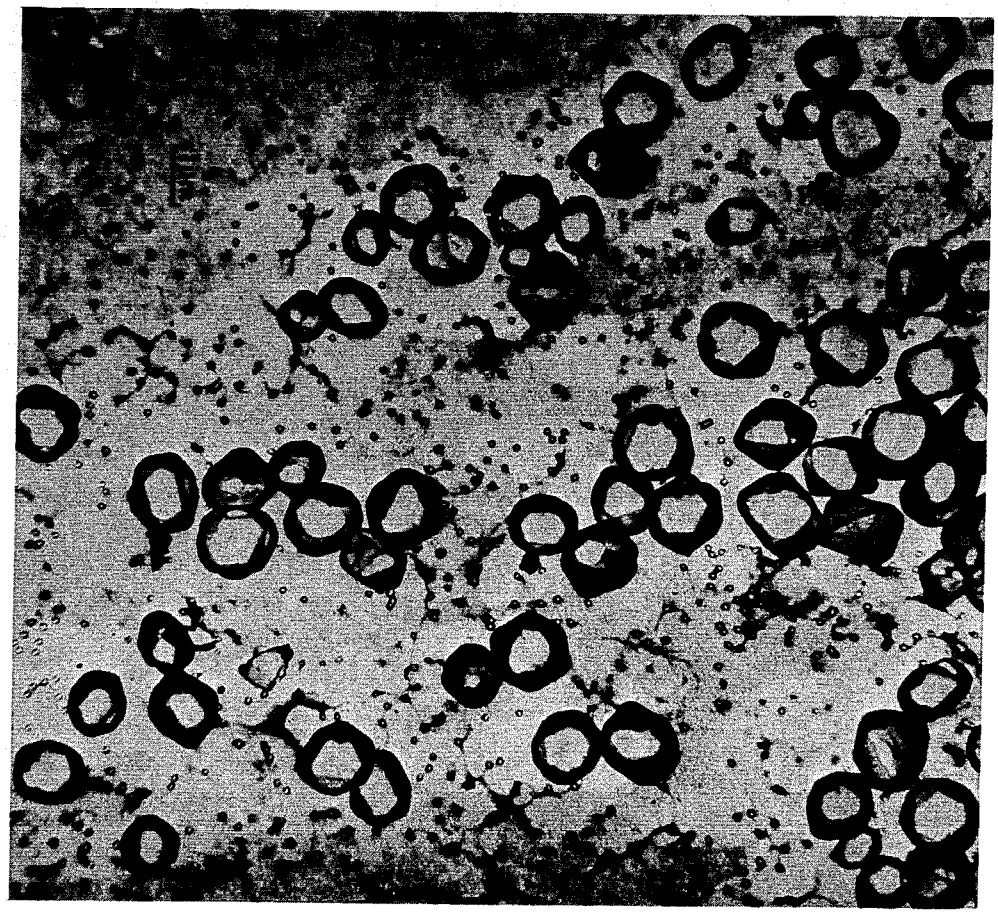
FIG. 5A is an electron micrograph of the emulsion prepared in Example 5.

Solutions 1 and 2 were simultaneously jetted into an agitated aqueous suspension containing 18.5 Kg of a 0.78 μm AgCl seed prepared according to the procedure of Example 3. The silver concentration of the seed was 75 mg/g of emulsion. The gelatin concentration of the seed was 37.5 mg/g of emulsion. The pH was about 5.6 and the batch temperature was 42° C. Solution 1 was jetted for 90 minutes at a pAg set point of 4.0 with an average flow rate of about 40 g/min. The pAg set point was readjusted to 8.5 and the flow rate of Solution 1 was increased to about 78 cc/min without stopping. This flow rate continued for an additional 278 minutes. The crystals were grown to a MVD of about 1.17 μm. The emulsion was washed; additional gelatin was added to produce a gelatin/silver ratio of 0.5 and the emulsion was chill set at 20° C. FIG. 5 is the x-ray diffraction trace of the grains prepared in Example 5. The regular habit was ascertained by electron microscopy as shown in FIG. 5A.

| | Cl/Br |
|---|---|
| Aim composition | 29/71 |
| Wet chemical analysis | 18/82 |
| X-ray diffraction | 8/92 |

EXAMPLE 6

Silver iodochlorobromide high disorder monodisperse emulsion

| | |
|---|---|
| Solution 1 | 3N silver nitrate in distilled water |
| Solution 2 | 3N potassium bromoiodide 1% KI, 99% KBr) in distilled water |

Figure 6:
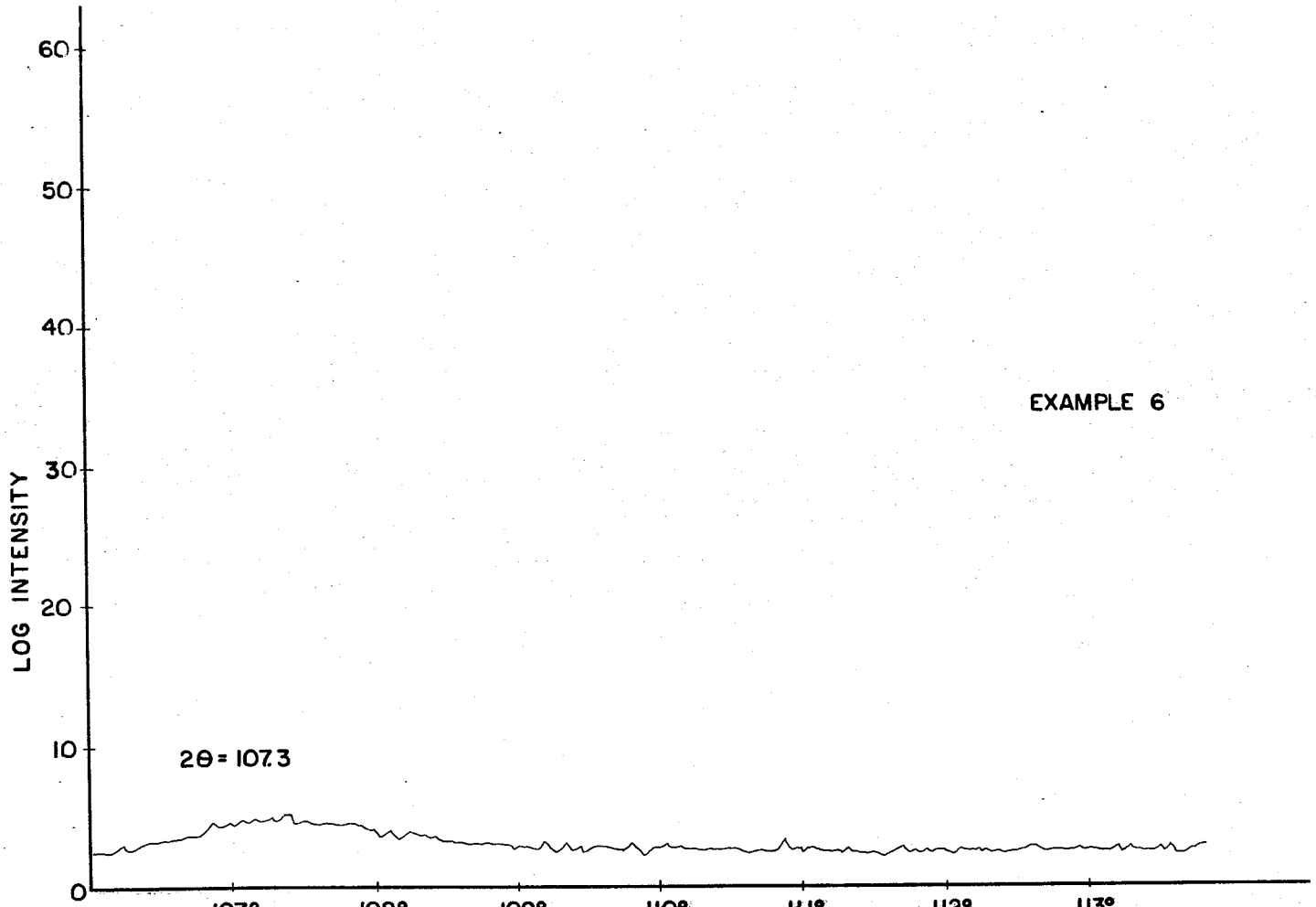
FIG. 6 is an x-ray diffraction trace of the grains prepared in Example 6.
Figure 6A:
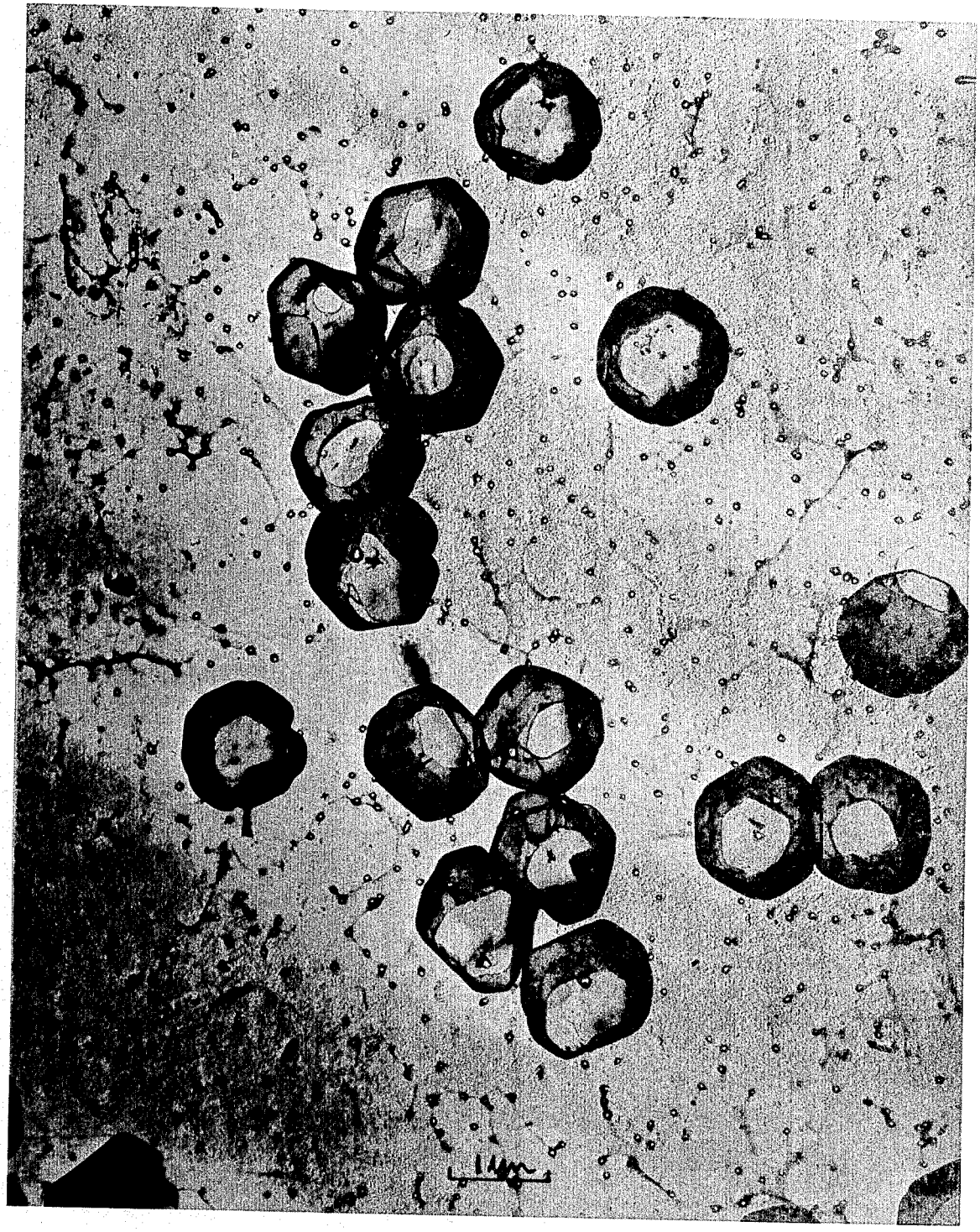
FIG. 6A is an electron micrograph of the emulsion prepared in Example 6.

Solutions 1 and 2 were simultaneously jetted into an agitated aqueous suspension containing 2.4 kg of the silver chloride seed crystals prepared according to the procedure of Example 4 at a temperature of 42° C. and a pH of about 5.6. The silver concentration of the seed was 287 mg/g of emulsion and the gelatin concentration was 144 mg/g of emulsion. The Solution 2 was jetted for 360 minutes with a pAg set point of 9.2 at an average flow rate of 10 cc/min to produce silver halide crystals with an MVD of 2.25 μm. The emulsion was washed; additional gelatin was added to produce a gelatin/silver ratio of 0.5 and the emulsion was chill set at 20° C. FIG. 6 is the x-ray diffraction trace of the grains prepared in Example 6. The regular habit was ascertained by electron microscopy as shown in FIG. 6A.

| | I/Cl/Br |
|---|---|
| Aim composition | 0.7/25/74.3 |
| Wet chemical analysis | 0.7/18/82.3 |
| X-ray diffraction | −/15/85 |

EXAMPLE 7

Silver iodochloride high disorder monodisperse emulsion

| | |
|---|---|
| Solution 1 | 3N silver nitrate in distilled water |
| Solution 2 | 3N potassium chloride in distilled water |
| Solution 3 | 3N potassium halide in distilled water (1% KI, 99% KBr) |

Figure 7:
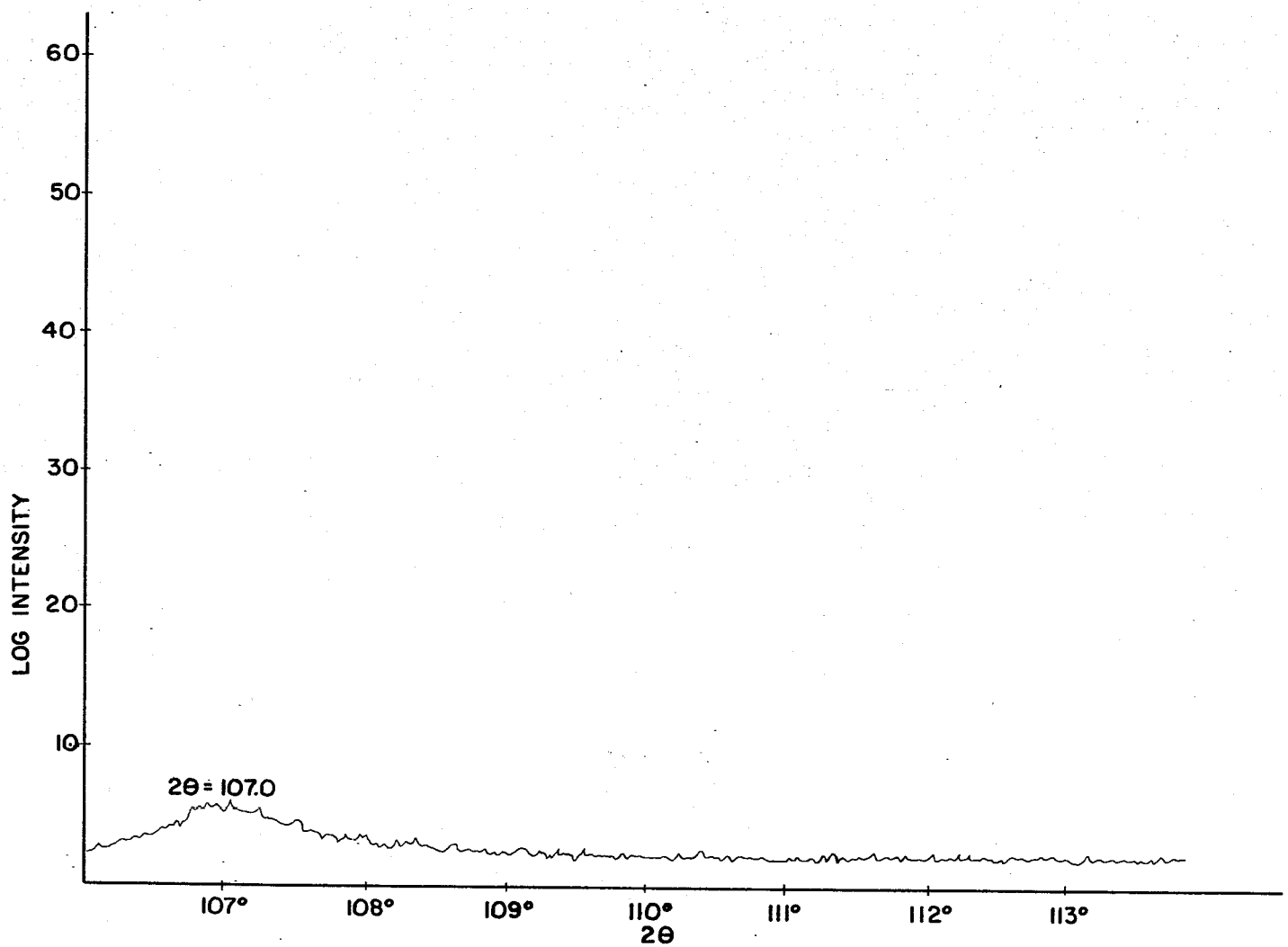
FIG. 7 is an x-ray diffraction trace of the grains of Example 7.
Figure 7A:
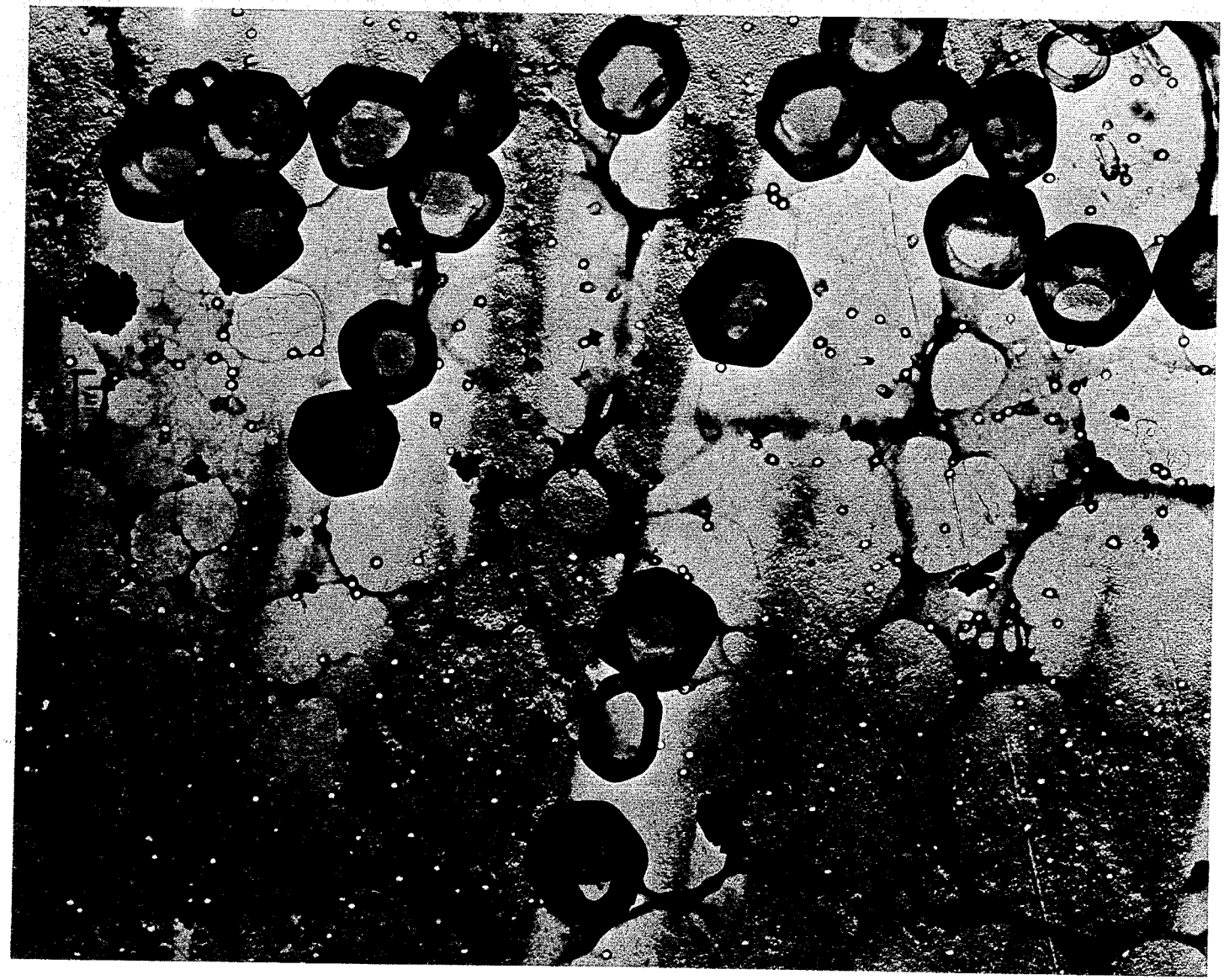
FIG. 7A is an electron micrograph of the emulsion prepared in Example 7.

This emulsion was made in consecutive growth stages without washing or removal of the intermediate emulsion stages. Solutions 1 and 2 were simultaneously jetted into an agitated aqueous 2 liter solution containing 100 g of photographically inert gelatin at 45° C. at a pAg set point of 4.0 and a pH of about 5.6. Solution 1 was jetted for 371 minutes at an average flow rate of 44 g/min to produce a silver chloride seed emulsion with a MVD of about 0.70 μm. The jets were turned off, and 15 liters of 10% gelatin solution preheated to 45° C. were added to the system and agitated for about 10 minutes. Then Solutions 1 and 3 were simultaneously jetted into the agitated vessel. Solution 1 was jetted for an additional 285 minutes at an average flow rate of 133 g/min to produce a silver halide emulsion with a MVD of 1.15 μm. The emulsion was washed; additional gelatin was added to produce a gelatin/silver ratio of 0.5 and the emulsion was chill set at 20° C. FIG. 7 is the x-ray diffraction trace of the grains prepared in Example 7. The regular habit was ascertained by electron microscopy as shown in FIG. 7A.

| | I/Cl/Br |
|---|---|
| Aim composition | 1/22/77 |
| Wet chemical analysis | 0.9/20/79.1 |

EXAMPLE 8

Silver iodochlorobromide high disorder monodisperse emulsion (1% iodide, 6% chloride, 93% bromide)

| | |
|---|---|
| Solution 1 | 3N silver nitrate in distilled water |
| Solution 2 | 3N potassium chloride in distilled water |
| Solution 3 | 3N potassium halide in distilled water (1% KI, 99% KBr) |

This emulsion was prepared in two consecutive growth stages without washing or removing the emulsion from the making vessel.

Solutions 1 and 2 were simultaneously jetted into an agitated solution of 20 liters containing 500 g of photographically inert gelatin at a temperature of 42° C. at a pAg set point of 5.3 and a pH of about 5.6 under white light during the entire jetting time. The light source was the same as in Example 3. Solution 1 was jetted for 375 minutes with an average flow of 50 g/min.

The average light intensity was 80 μwatts/cm$^2$ over a surface area of 720 cm$^2$. The silver chloride grains had a MVD of about 0.6 μm. At this time the addition of Solution 2 was stopped, the white light was turned off, and Solution 3 was turned on. Solution 1 was jetted for 420 minutes with an average flow rate of 102 g/min at a pAg set point of 8.8 to produce a emulsion having grains with a MVD of about 1.54 μm. The emulsion was washed; additional gelatin was added to produce a gelatin/silver ratio of 0.5 and the emulsion was chill set at 20° C.

Figure 8:
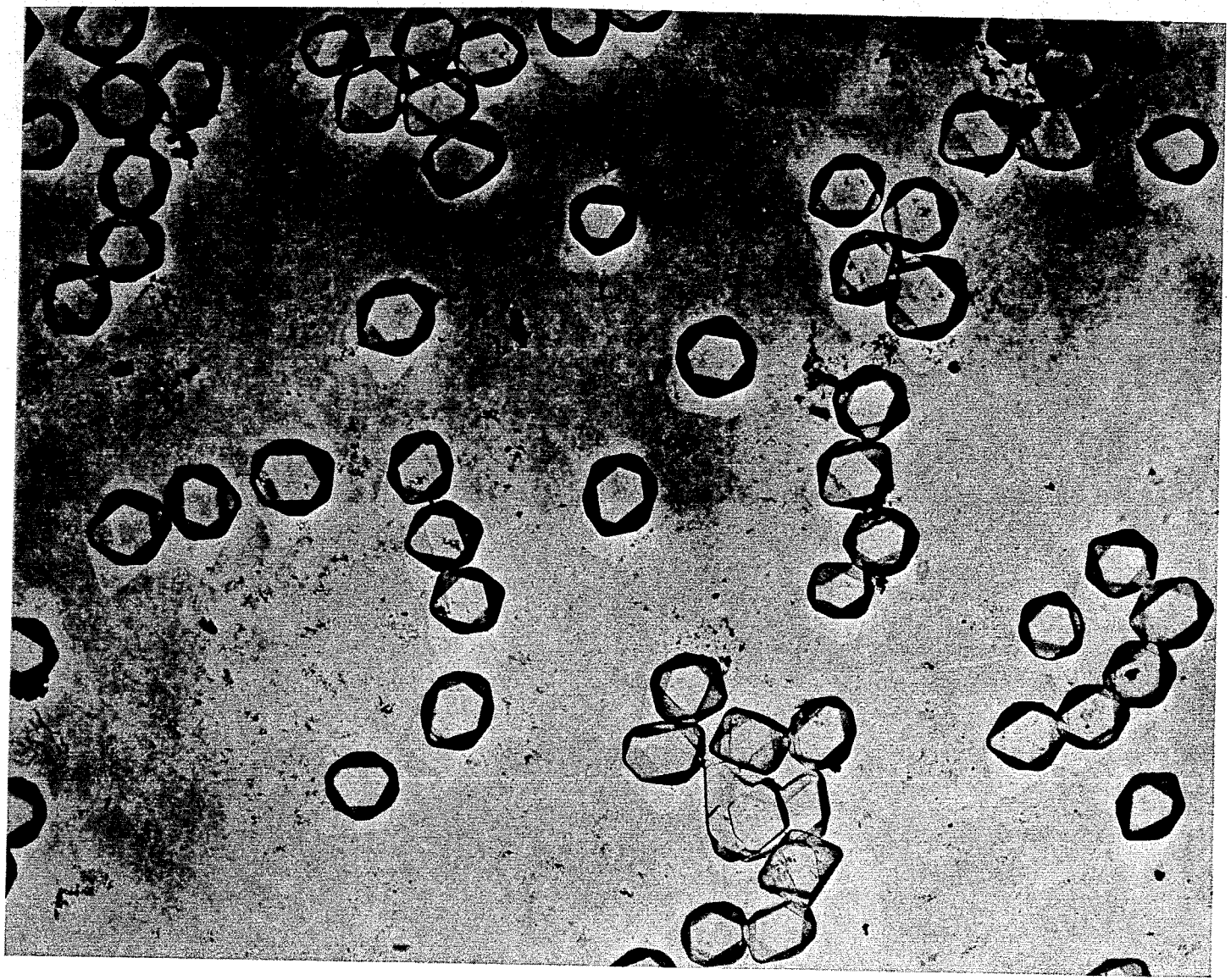
FIG. 8 is an electron micrograph of the emulsion prepared in Example 8.

FIG. 8 is an electron micrograph of the emulsion prepared in Example 8.

EXAMPLE 9

Monodisperse iodochlorobromide annealed emulsion

| | |
|---|---|
| Solution 1 | 3M silver nitrate in distilled water |
| Solution 2 | 3M potassium halide (0.5% KI, 99.5% KBr) in distilled water |

Using the procedure in Example 3 a silver chloride first stage (seed) emulsion was prepared having a MVD of about 0.38 μm. The emulsion was washed and additional inert gelatin was added to bring the gelatin to silver ratio to 0.5. The emulsion was then chill set at 20° C.

Solutions 1 and 2 were simultaneously jetted into the agitated 42° C. aqueous 2 liter suspension containing 1.1 Kg of the 0.38 μm AgCl seed emulsion. The silver concentration of the seed emulsion was 94 mg/g and the gelatin concentration was 37 mg/g. At a pAg set-point of 8.5, and a pH of about 5.6, Solution 1 was added at an average flow rate of 6.3 g/min for 567 minutes. After 510 minutes, 240 g of a 28% ammonium hydroxide solution was added to the growing emulsion. At 567 minutes, the jetting was stopped and at 610 minutes the ammonium hydroxide containing solution was neutralized to a pH of 7. Agitation continued for an additional 18 hours at 42°. The emulsion was then washed; additional gelatin was added to produce a gelatin/silver ratio of 0.5 and the emulsion was chill set at 20° C.

Examining the x-ray diffraction traces of Examples 1, 2, and 3, it will be seen that definite peaks (well resolved doublets) are seen in FIGS. 1, 2, and 3 indicating an ordered crystal of AgBr, AgClBr and AgCl, respectively. It should be noted that the procedures set forth in Examples 1, 2 and 3 constitute procedures for preparing conventional monodisperse emulsions. That the emulsions are monodisperse can be seen in the photomicrographs (FIGS. 1A, 2A and 3A).

By contrast, emulsions of the present invention, as prepared in Examples 5, 6 and 7, show x-ray diffraction traces with extensive line broadening (FIGS. 5, 6 and 7) i.e., the diffraction peaks are not well-defined indicating unexpected extensive disorder and possibly non-uniform halide distribution in the crystal which contribute to increased speed and other advantages not found in prior art monodisperse emulsions. That the emulsions are monodisperse is shown in the photomicrographs (FIGS. 5A, 6A and 7A).

Example 3 details the preparation of a seed silver chloride emulsion. FIG. 3 is the x-ray diffraction trace of the grains prepared in Example 3 and shows the well-resolved doublets one would expect from a crystal with an ordered structure. The uniformity of grain size and habit is shown in the photomicrographs (FIG. 3A). It should also be noted that Example 3 describes the preparation of a seed emulsion under white light illumination.

Figure 9:
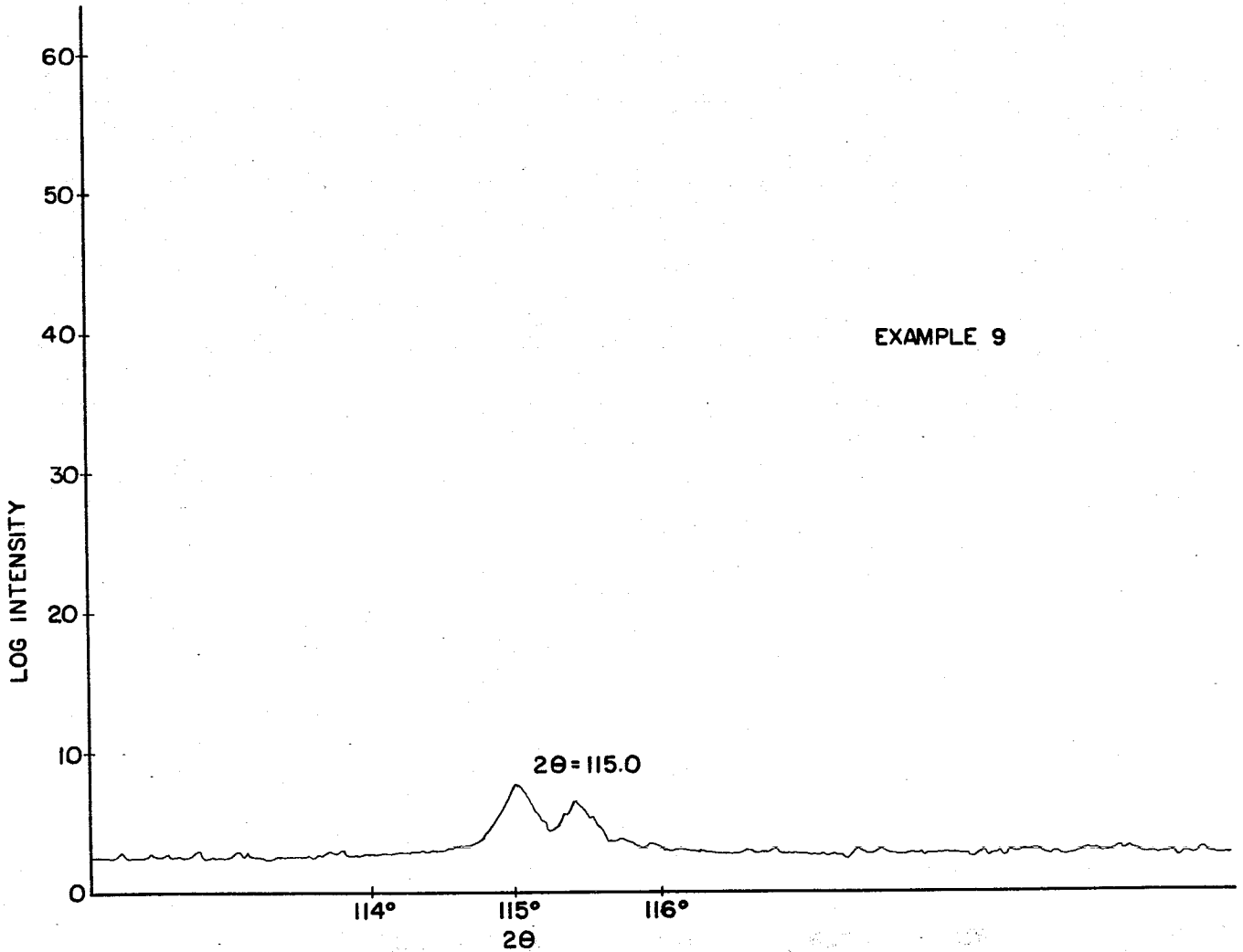
FIG. 9 is an x-ray diffraction trace of the emulsion of Example 9.
Figure 9A:
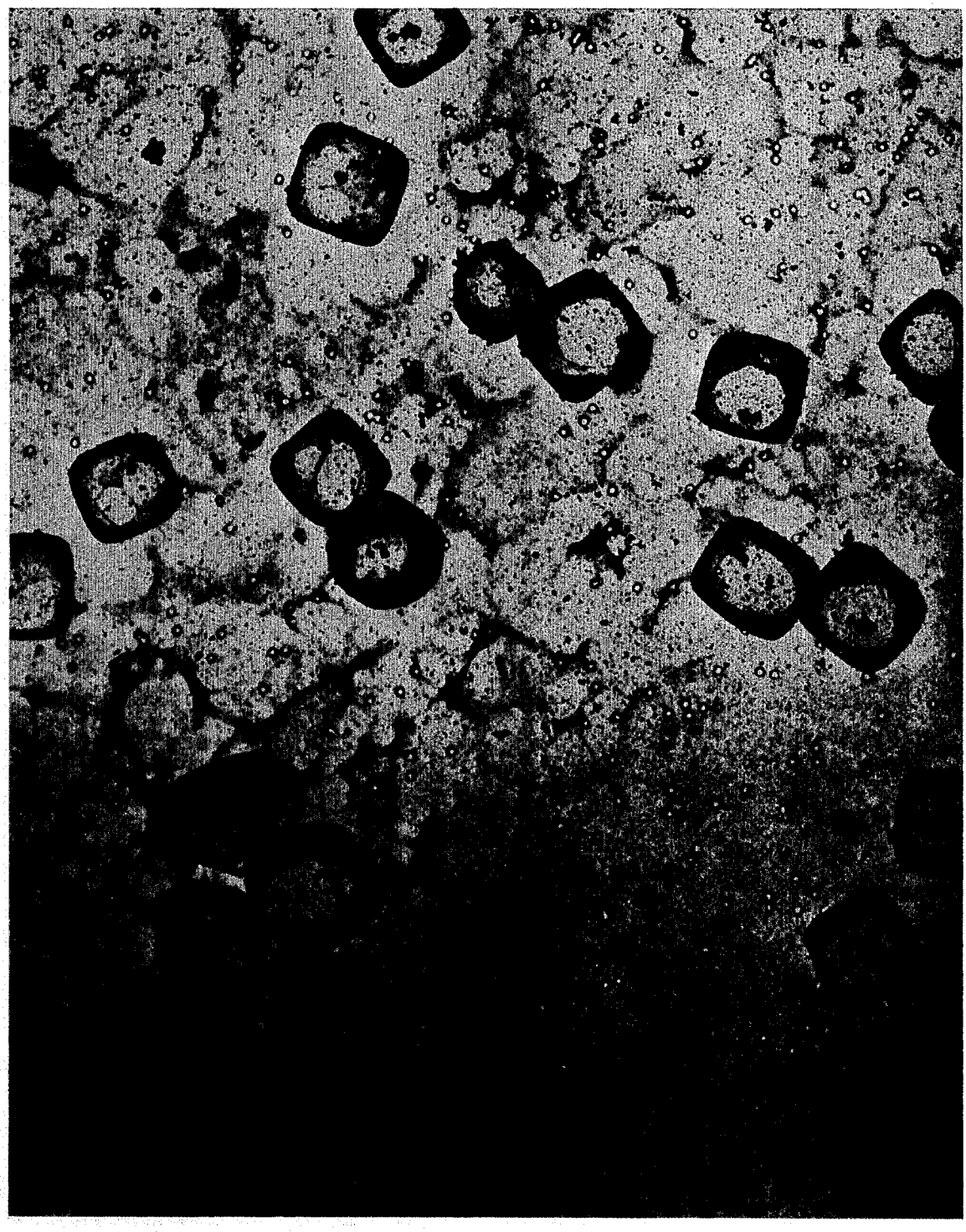
FIG. 9A is an electron micrograph of the emulsion of Example 9.

To further demonstrate the effects obtained by crystal disorder in the grain, an emulsion was prepared in Example 9 according to the procedure of the present invention, except that during the final stages of grain growth, the grains were annealed in the presence of ammonium hydroxide by holding the emulsion in a liquid state at a temperature in excess of 36° C. for 18 hours. Reference to the x-ray diffraction trace (FIG. 9) shows the well-resolved doublet, typical of a conventional monodisperse emulsion having an ordered crystal structure. The annealing has resulted in reorientation of the chloride in the crystal, releasing the unstable crystal condition and producing a more ordered crystal structure and uniform halide distribution. FIG. 9A show the grain habit and size.

EXAMPLE 10

High disorder monodisperse iodochlorobromide emulsion

Figure 10:
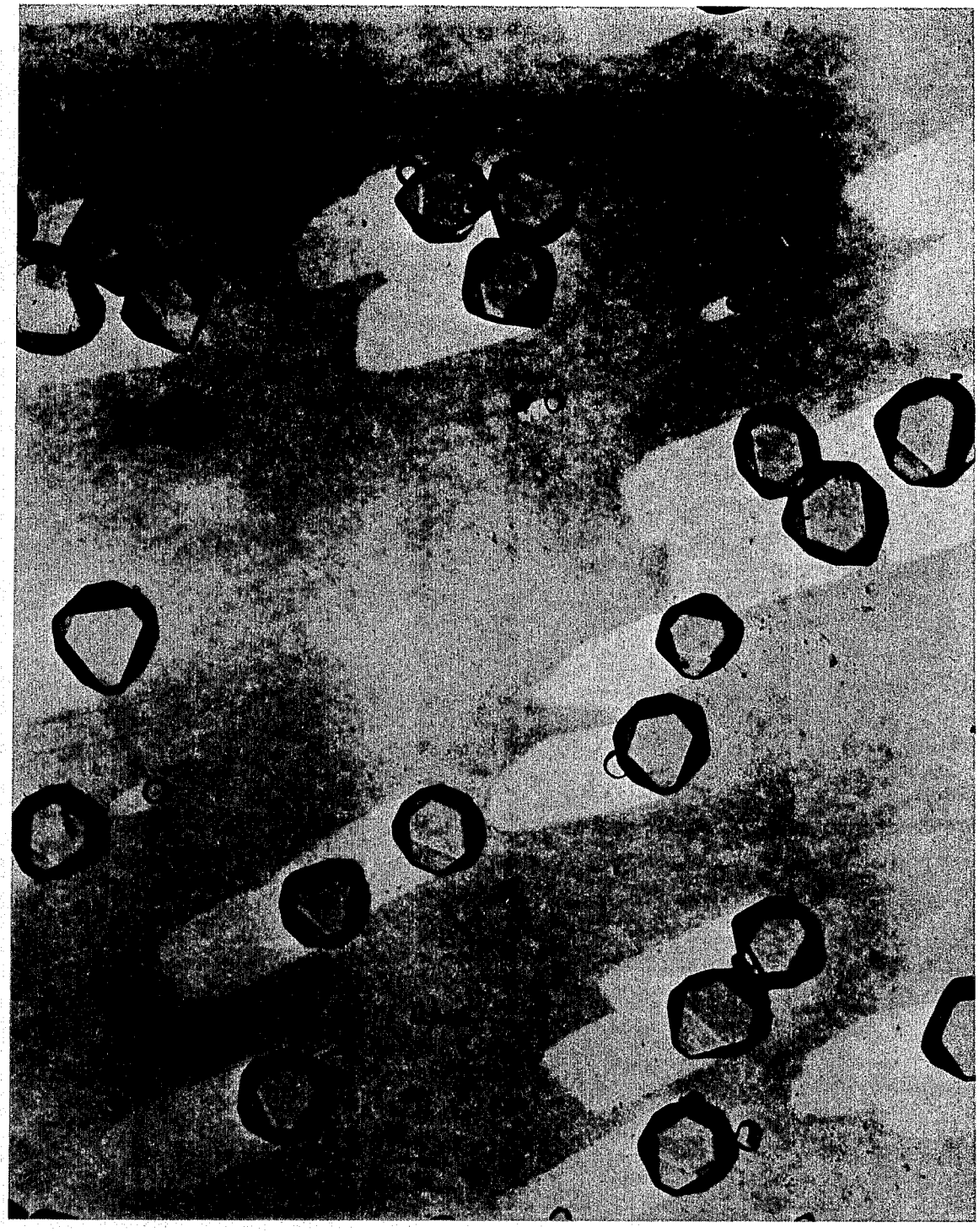
FIG. 10 is an electron micrograph of the emulsion prepared in Example 10.

This emulsion was made in two consecutive growth steps without an intermediate washing step following the procedure of Example 7. The seed emulsion had a MVD of about 1.06 μm and the emulsion after the second stage had a MVD of about 1.56 μm. The regular habit of the emulsion is shown by the electron micrograph in FIG. 10

Examples 11 and 12 illustrate the preparation of relatively large grain sizes and Example 12 also illustrates the use of chloride in Solution 3.

EXAMPLE 11

High disorder monodisperse silver halide emulsion (36% chloride, 64% bromide)

| | |
|---|---|
| Solution 1 | 3N silver nitrate in distilled water |
| Solution 2 | 3N potassium chloride in distilled water |
| Solution 3 | 3N potassium bromide in distilled water |

Figure 11:
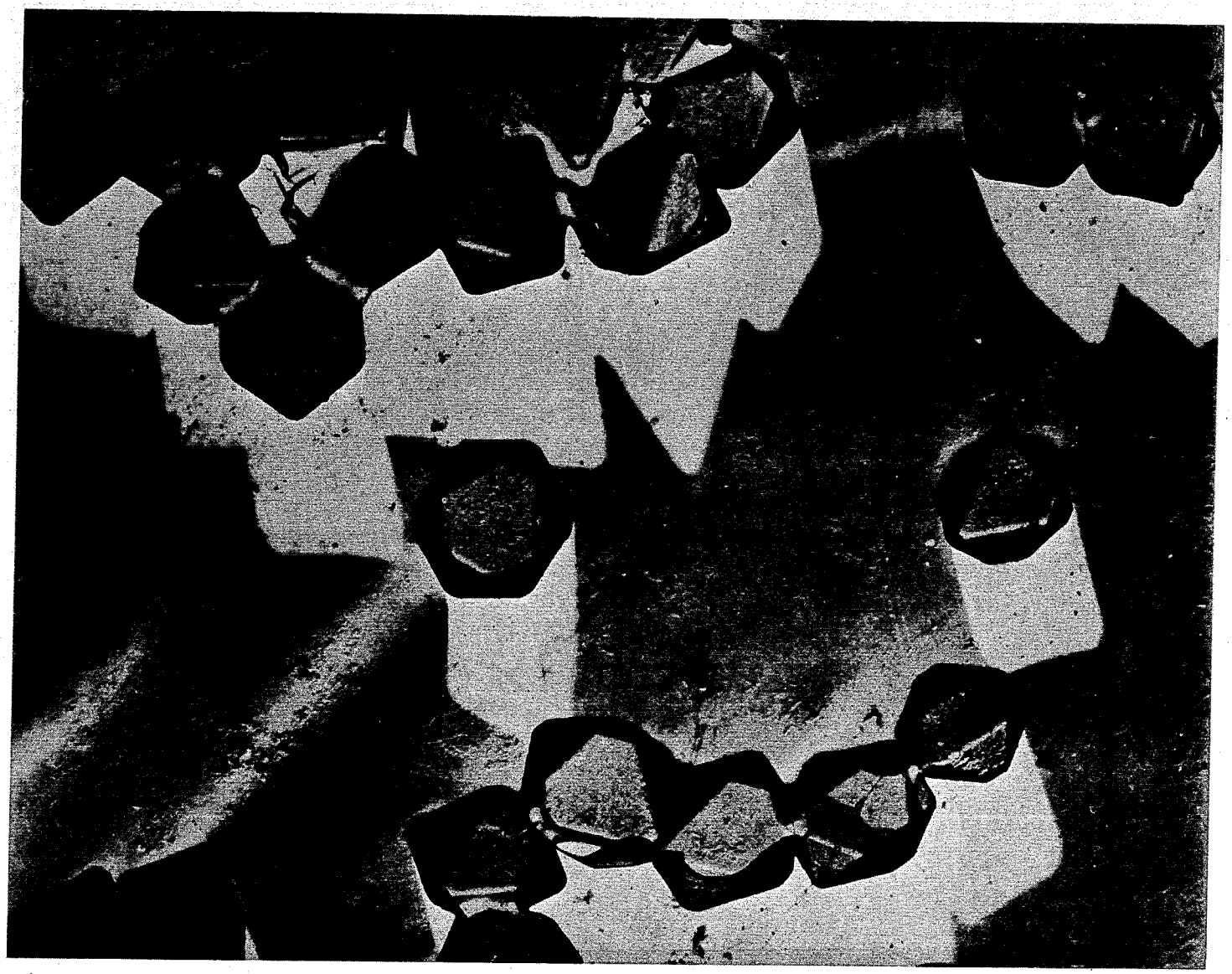
FIG. 11 is an electron micrograph of the emulsion prepared in Example 11.

This emulsion was made in two consecutive non-interrupted stages according to the procedure of Example 8. The first stage emulsion was prepared using Solutions 1 and 2 to provide grains having a MVD of about 1.19 μm. In the second stage the grains were further grown using Solutions 1 and 3 to provide grains having a MVD of about 2.68 μm. Inert gelatin was added to bring the gelatin to silver ratio to 0.5 and then the emulsion was chill-set at 20° C. The regular habit of the emulsion is shown in FIG. 11.

EXAMPLE 12

High disorder monodisperse iodochlorobromide emulsion

| | |
|---|---|
| Solution 1 | 3N silver nitrate in distilled water |
| Solution 2 | 3N potassium chloride in distilled water |
| Solution 3 | 3N potassium halide (1% KI, 5% KCl, 94% KBr) in distilled water |

Figure 12:
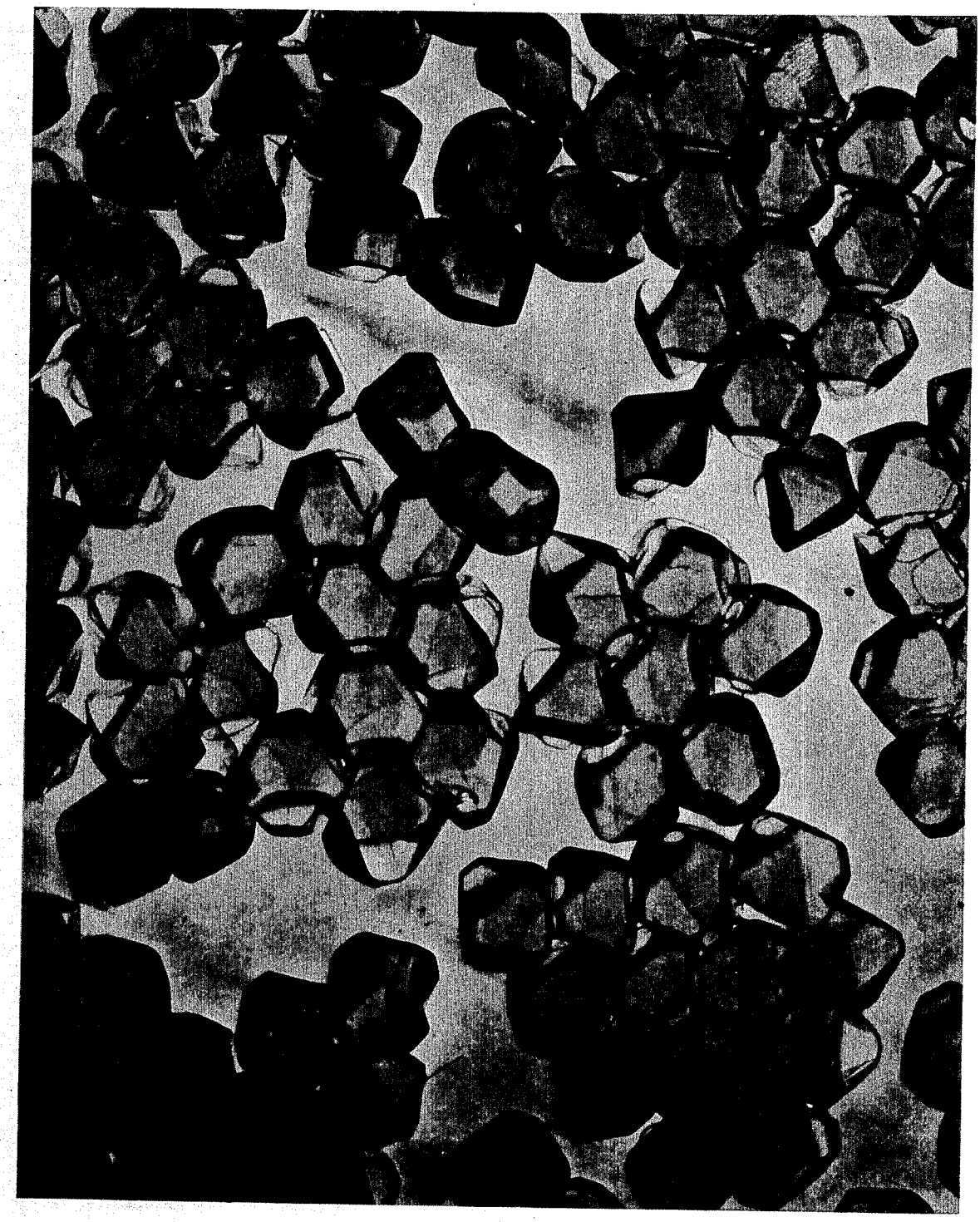
FIG. 12 is an electron micrograph of the emulsion prepared in Example 12.

This emulsion was made in two consecutive non-interupted stages according to the procedure of Example 8. In the first stage, Solutions 1 and 2 were simultaneously jetted to produce silver chloride seed grains with a MVD of about 1.19 μm. In the second stage, Solutions 1 and 3 were jetted to produce grains having a MVD of about 2.68 μm. The emulsions were washed and then photographically inert gelatin was added to produce a gelatin to silver ratio of 0.5 and then the emulsion was chill set at 20° C. The regular habit of the final emulsion is shown by the electron micrograph in FIG. 12.

EXAMPLE 13

Conventional monodisperse iodobromide emulsion

| | |
|---|---|
| Solution 1 | 3N silver nitrate in distilled water |
| Solution 2 | 3N potassium halide (0.5% KI, 99.5% KBr) in distilled water |

Figure 13:
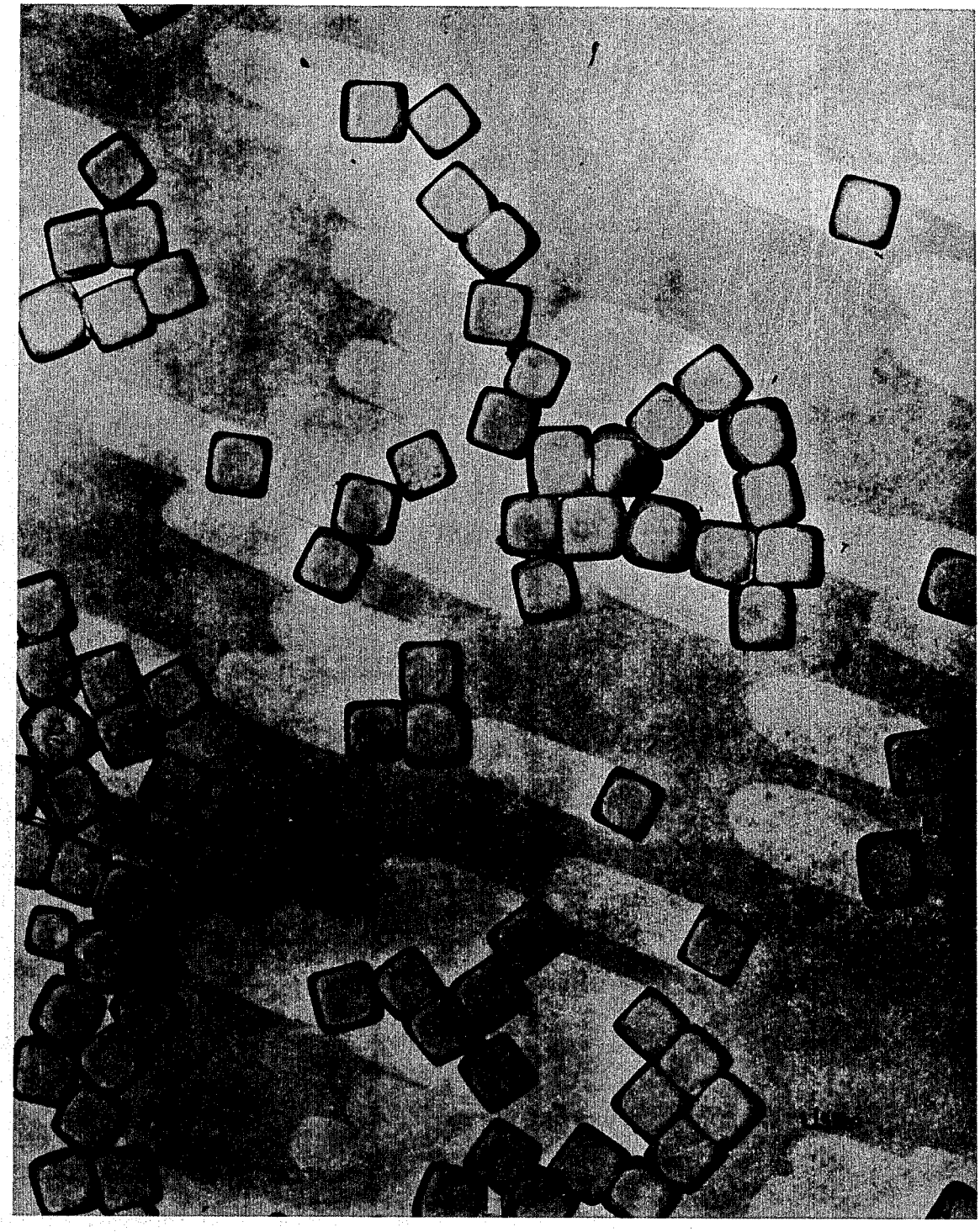
FIG. 13 is an electron micrograph of the emulsion prepared in Example 13.

This emulsion was prepared using the procedure of Example 1 with a pAg set point at 5.5 and a pH at about 5.8 for a time sufficient to grow the grains to a MVD of about 1.33 μm. The emulsion was washed and additional gelatin was added to adjust the gelatin to silver ratio to 0.5 and then the emulsion was chill set at 20° C. The electron micrograph of this emulsion is shown in FIG. 13.

EXAMPLE 14

Conventional polydisperse single-jet emulsion

| | |
|---|---|
| Solution 1 | 0.5N silver nitrate in distilled water |

Figure 14:
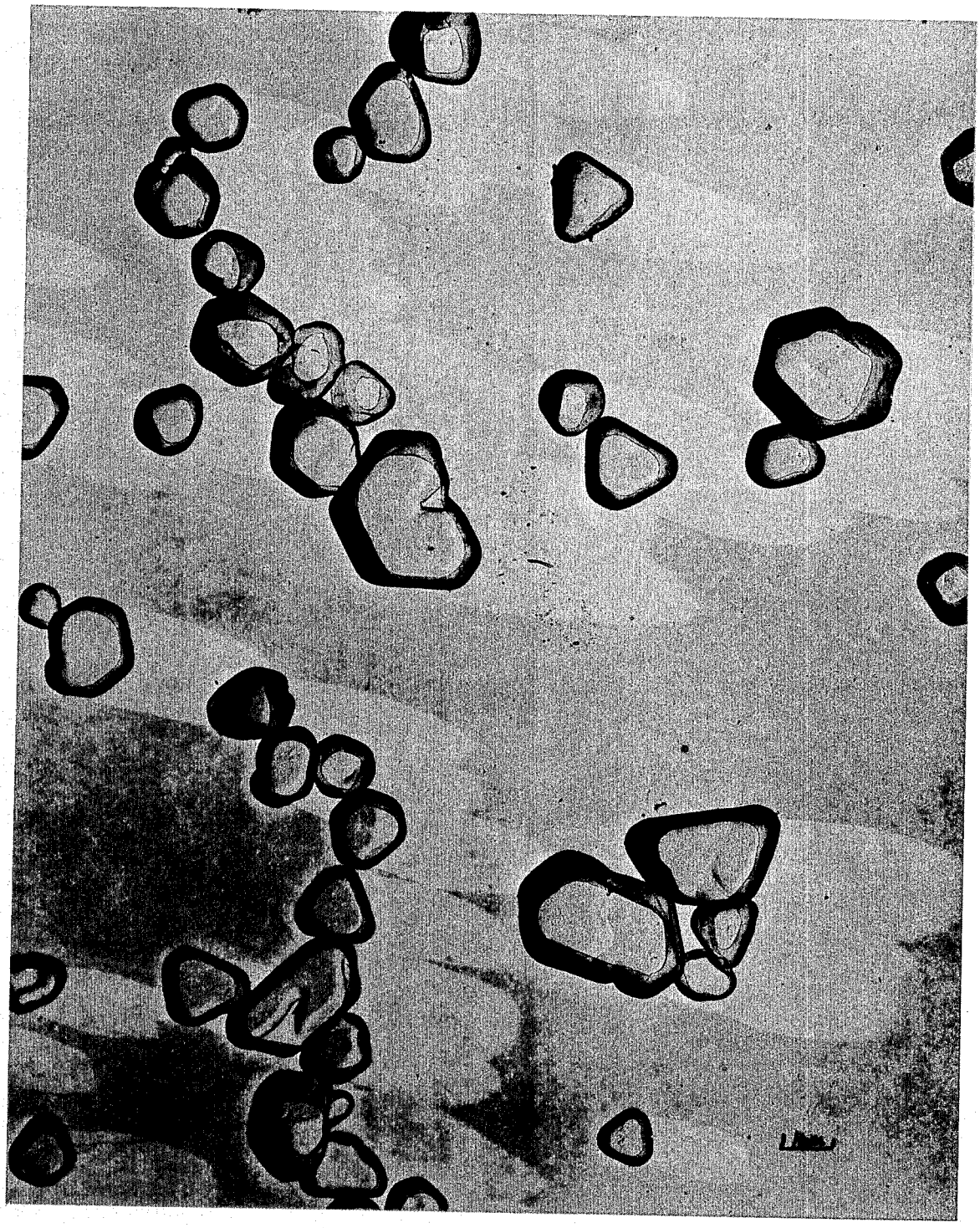
FIG. 14 is an electron micrograph of the emulsion prepared in Example 14.
Figure 14A:
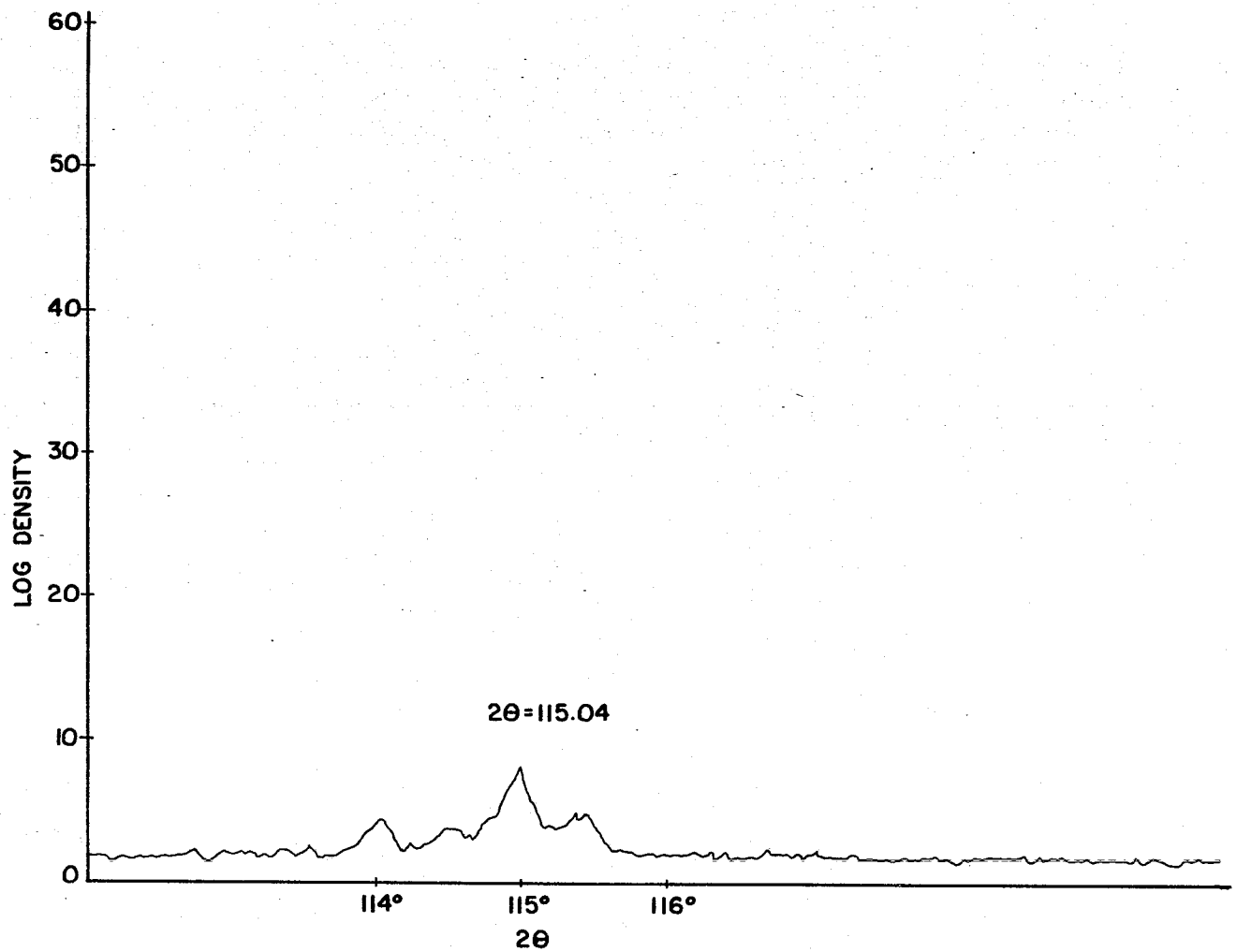
FIG. 14A is an x-ray diffraction trace of the grains of Example 14.

Solution 1 was preheated to 29° C. and jetted into an agitated 28.5 l aqueous solution containing 184 g of inert gelatin; 4677 g of potassium bromide and 488 g of potassium iodide at 42° C. for 25 minutes at a flow rate of 2200 g/min to produce an emulsion with grains having a MVD of about 1.53 μm. The emulsion was washed, additional gelatin added to provide a gelatin to silver ratio of 0.5 and then chill-set at 20° C. FIG. 14 shows an electron photomicrograph of the emulsion from Example 14. FIG. 14A shows the x-ray diffraction trace of the emulsion prepared in Example 14.

The emulsions of Example 8, 10, 13 and 14 were given the same chemical sensitization and were evaluated by coating over a base carrying 700 mg/m$^2$ of a cyan dye developer at a coverage of 1350 mg/m$^2$ of silver. The thus-formed negatives were exposed to a step tablet using white light, and processed with the processing composition set forth below and an image-receiving element from a Polaroid SX-70 film unit (Polaroid Corporation, Cambridge, Mass.) to form a reflection print by passing the negative and image-receiving element, with the processing composition spread therebetween, between laboratory rollers having a 2.6 mil gap.

| PROCESSING COMPOSITION | Weight % |
|---|---|
| Potassium hydroxide | 4.0 |
| N-phenethyl-α-picolinium bromide (50% solution in water) | 1.3 |
| Sodium carboxymethyl hydroxyethyl cellulose | 1.72 |
| Titanium dioxide | 34.5 |

-continued

| PROCESSING COMPOSITION | Weight % |
|---|---|
| Benzotriazole | 0.8 |
| 6-methyl-5-bromo-4-azabenzimidazole | 0.02 |
| Water | 57.66 |

The sensitometric data reported in Table 1 was collected with a recording densitometer measured through the transparent cover of the image-receiving element.

TABLE 1

| Example | Mean Volume Diameter (μm) | $D_{max}$ | Shoulder Speed | Toe Speed | $D_{min}$ | Slope | Dynamic Range |
|---|---|---|---|---|---|---|---|
| 8 | 1.54 | 1.98 | 3.40 | 2.84 | 0.18 | 1.49 | 24.0 |
| 10 | 1.56 | 2.30 | 3.48 | 2.38 | 0.21 | 1.45 | 60.1 |
| 13 (Control) | 1.33 | 1.87 | 2.76 | 2.49 | 0.14 | 3.86 | 8.7 |
| 14 (Control) | 1.53 | 2.14 | 3.18 | 2.51 | 0.15 | 2.03 | 28.5 |

Compared to Examples 8 and 10, the conventional monodisperse emulsion of Example 13, while slightly smaller in grain size, shows a much lower $D_{max}$, a significantly lower shoulder speed, very high slope and very small dynamic range. Table 1 also shows that the novel monodisperse emulsions of the present invention exhibit the high shoulder speed, low slope and long dynamic range usually found in polydisperse emulsions (Example 14).

The following examples were prepared to show the advantages achieved by carrying out the novel process of the present invention employing a silver chloride seed emulsion prepared in the presence of white light illumination.

EXAMPLE 15

High disorder chlorobromide monodisperse emulsion

| | |
|---|---|
| Solution 1 | 3N silver nitrate in distilled water |
| Solution 2 | 3N potassium chloride in distilled water |
| Solution 3 | 3N potassium bromide in distilled water |

Following the procedure of Example 4 a silver chloride seed was made by jetting Solutions 1 and 2 to produce an emulsion with grains having a MVD of about 0.37 μm. This seed was washed and chill-set at 20° C. The second stage of the emulsion was prepared by the procedure of Example 6 employing Solutions 1 and 3 to produce an emulsion with grains having a MVD of about 0.68 μm.

EXAMPLE 16

High disorder monodisperse chlorobromide emulsion

This emulsion was made employing the procedure of Example 3 for the first stage and the procedure of Example 5 for the second stage.

-continued

| | |
|---|---|
| Solution 1 | 3N silver nitrate in distilled water |
| Solution 2 | 3N potassium chloride in distilled water |
| Solution 3 | 3N potassium bromide in distilled water |

The seed emulsion was prepared with white light illumination by jetting Solutions 1 and 2 to provide an emulsion with grains having a MVD of about 0.33 μm. The illumination employed was about 41,400 uwatts/cm$^2$ over an area of 153 cm$^2$ with an initial batch volume of 2 liters and a final batch volume of about 30 liters. The emulsion was then washed and set up at 20° C. The illumination during the seed preparation was provided by a 275 watt RS Sun lamp for 210 min. The second stage Solutions 1 and 3 were employed to produce an emulsion with grains having a MVD of about 0.61 μm.

EXAMPLE 17

High disorder monodisperse chlorobromide emulsion

| | |
|---|---|
| Solution 1 | 3N silver nitrate in distilled water |
| Solution 2 | 3N potassium chloride in distilled water |
| Solution 3 | 3N potassium bromide in distilled water |

The first stage of the emulsion was prepared according to the procedure of Example 4 without illumination by employing Solutions 1 and 2 to produce an emulsion with grains having a MVD of about 0.33 μm. The total volume of the emulsion at this time was about 30 liters. The agitated emulsion was then illuminated with about 41,400 uwatts/cm$^2$ over an area of 153 cm$^2$ for 210 minutes using a 275 watt RS sun lamp. This illumination was carried out according to a procedure disclosed in British Pat. No. 1,027,146 published Apr. 27, 1966. The second stage employed the thus-irradiated emulsion as a seed and followed the procedure of Example 6. Solutions 1 and 3 were employed to produce an emulsion with grains having a MVD of about 0.51 μm. The emulsion was washed, additional gelatin added to produce a gelatin to silver ratio of 0.5 and the resulting emulsion was chill set at 20° C.

These emulsions of Examples 15, 16 and 17 were evaluated by the same procedure as described above using the described cyan monochrome, processing composition and procedure. The shoulder speeds are set forth in Table 2.

TABLE 2

| | |
|---|---|
| Example 15 | 1.94 |
| Example 16 | 1.96 |
| Example 17 | 1.11 |

From the foregoing it will be noted that the emulsion having a seed prepared in white light (Example 16) has a speed substantially the same as the emulsion prepared entirely in the dark (Example 15), while the emulsion having the seed prepared in the dark and exposed to white light subsequent to preparation shows a significant speed loss by comparison (Example 17).

Figure 15:
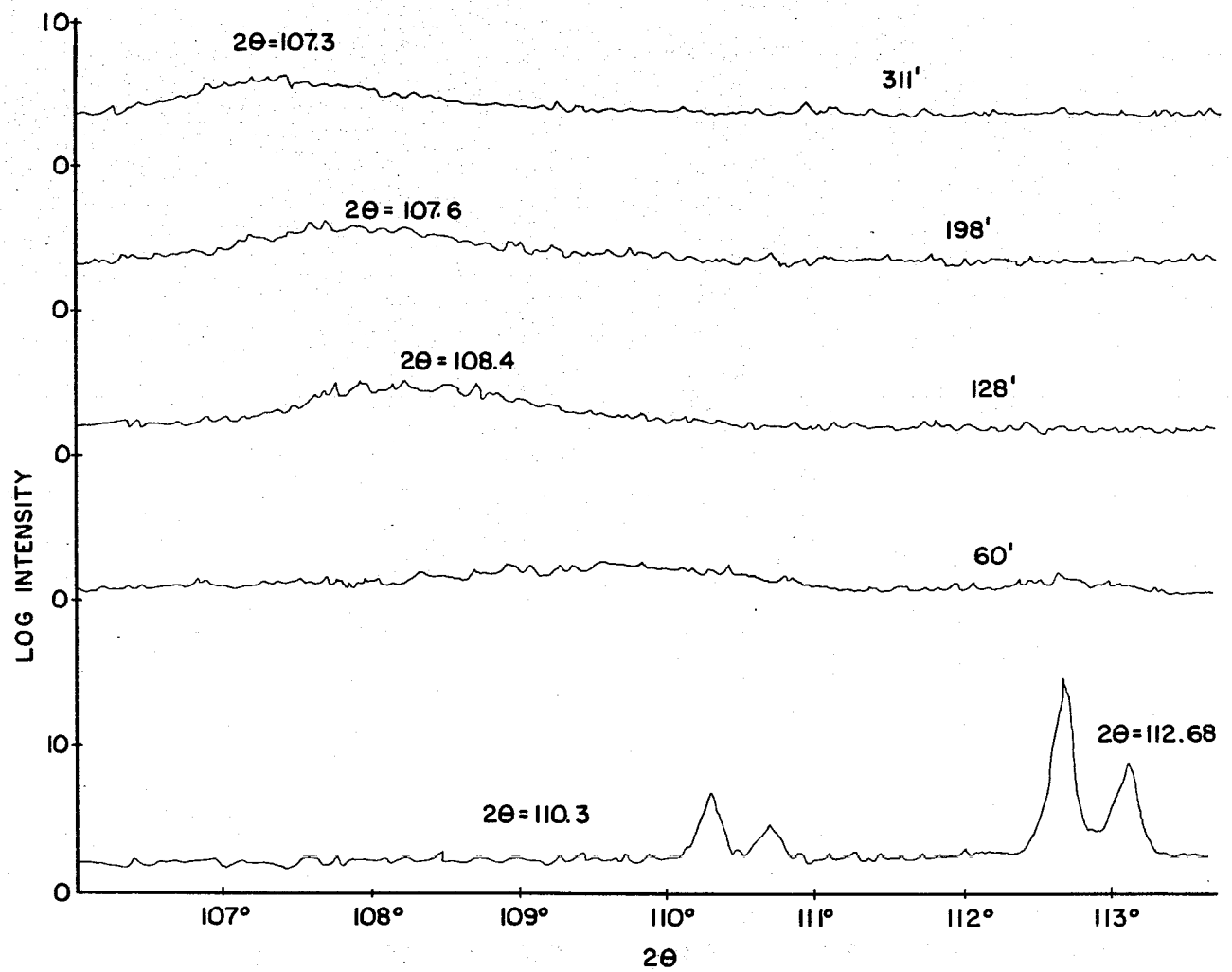
FIG. 15 is a series of x-ray diffraction traces of samples taken from the emulsion during second stage precipitation in Example 6.

FIG. 15 is an x-ray diffraction trace of the emulsion prepared according to the procedure of Example 6 wherein the emulsion was sampled for x-ray diffraction analysis at the indicated periods of time during the second stage precipitation. The bottom trace is the seed emulsion of Example 4 showing the silver chloride doublets as well-defined peaks. The 60 minute sample shows extensive line broadening to the extent that the Bragg angle cannot be determined. However, some line broadening is seen in the silver chloride reflection area, e.g., 112.68°. It is believed that this very broad and diffuse pattern is due not only to crystal disorder but also to a gradation of chloride concentration from the center of the growing grain to the surface. In subsequent samples, the continued extensive disorder is observed. Although no well defined peaks are formed, the calculations of the Bragg angle show the bromide content is increasing. In none of the subsequent samples is a well-defined silver bromide or silver chloride peak found.

Figure 16:
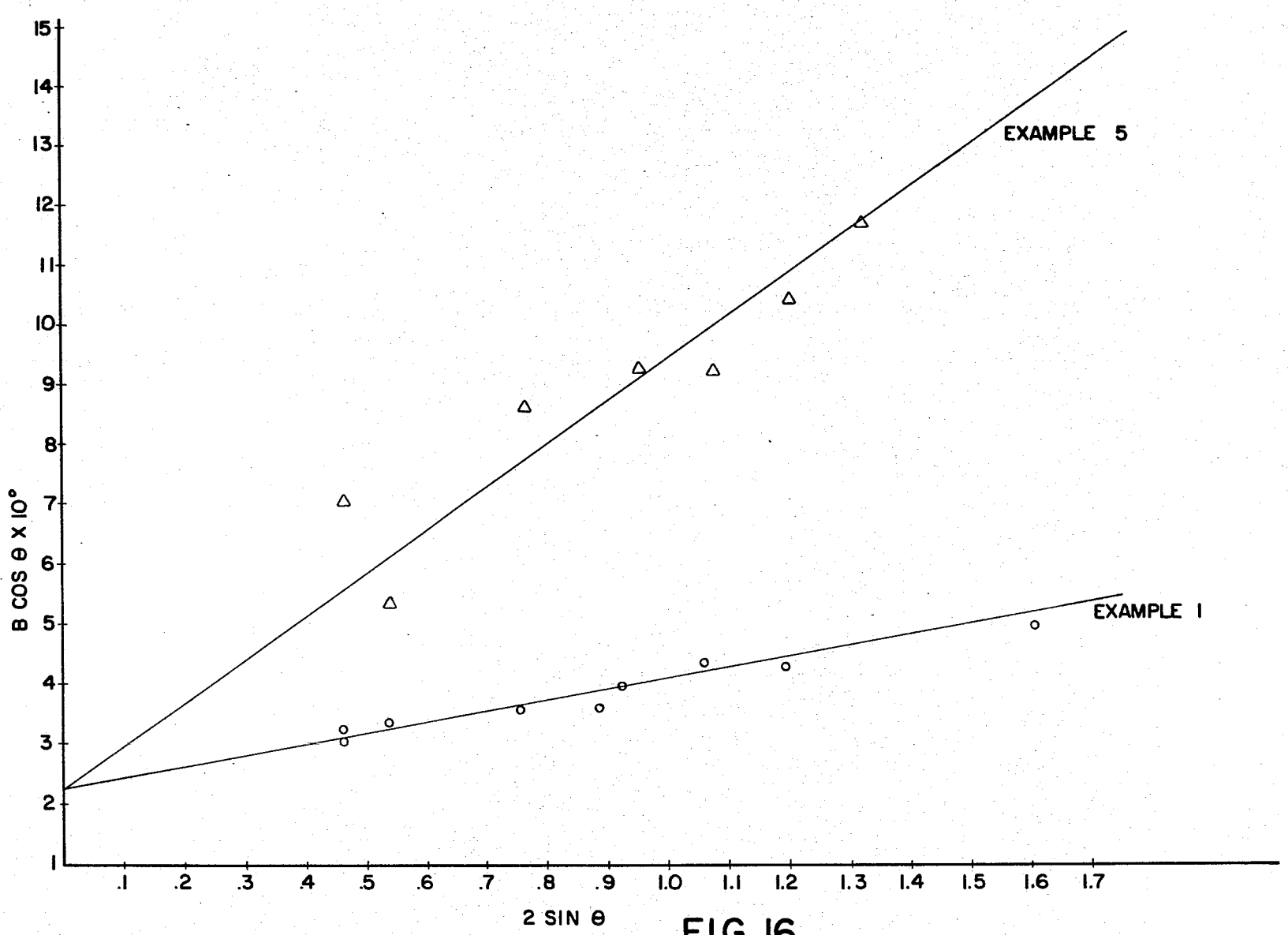
FIG. 16 is a plot of cos vs 2 sin derived from x-ray diffraction traces for Examples 1 and 5.

As indicated above, the crystal disorder in the grains prepared by the procedure of the present invention can be quantified by plotting $\beta \cos \theta$ vs $2 \sin \theta$. FIG. 16 is a graph showing the plots of $\beta \cos \theta$ vs $2 \sin \theta$ for Examples 1 and 5. The relatively flat slope of Example 1, a prior art monodisperse emulsion, indicates the grains are relatively strain-free whereas the steep slope of Example 5, 3.7 times the slope of Example 1, shows extensive crystal disorder.

The final grain size of the emulsions of the present invention ranges from about 0.3 μm to 3.0 μm. Preferably, seed emulsions having grain sizes of 0.15 μm to 2.0 μm are employed.

As stated above, the silver halide emulsions of this invention are particularly useful as negative working emulsions. They may be chemically sensitized, optically sensitized, coated, stabilized, etc., in the same manner and with the same reagents and aids as conventional negative working silver halide emulsions.

What is claimed is:

1. A method for forming a monodisperse, negative-working silver halide emulsion comprising silver chlorobromide or silver iodochlorobromide wherein said grains have a relatively high level of internal disorder in the crystal structure and a uniform habit which comprises precipitating silver halide in the presence of a monodisperse, predominantly silver chloride seed emulsion having a cubic habit under conditions wherein substantially none of the silver chloride is redissolved and substantially no additional grains are formed.

2. The method as defined in claim 1 wherein said precipitation is carried out at a pAg of between about 7 and 9.

3. The method as defined in claim 1 wherein said seed emulsion is prepared by precipitating silver chloride at a pAg of about 2.5 to 6 and a pH of less than about 7.

4. The method as defined in claim 3 wherein said pAg is about 4 and said pH is about 5.6.

5. The method of claim 3 or 4 wherein said seed emulsion is not removed from the vessel in which it is formed and said precipitation of silver halide is carried out substantially immediately.

6. The method of claim 1 wherein said silver halide precipitation is carried out in the presence of an unwashed seed emulsion.

7. The method of claim 1 wherein said seed emulsion is prepared under radiation actinic to silver chloride.

8. The method of claim 1 wherein the halide of said seed emulsion comprises about 51–100% chloride, 0–49% bromide and 0 to 49% iodide, and the halide content of said silver halide precipitated in the presence of said seed comprises 75 to 100% bromide, 0 to 20% chloride and 0 to 20% iodide.

9. The method of claim 8 wherein the halide of the seed emulsion is 100% chloride.

10. The method of claim 1 wherein said seed emulsion ranges from about 0.15–2.0 μm.

11. A method for forming a monodisperse, negative-working silver halide emulsion comprising silver chlorobromide or silver iodochlorobromide grains wherein said grains have a relatively high level of internal disorder and a uniform habit in the crystal structure and which comprises the steps of precipitating predominantly silver chloride grains at a pAg of about 2.6 to 6 and a pH less than about 7 and then precipitating silver halide in the presence of said silver chloride grains under conditions wherein substantially none of the silver chloride is dissolved and substantially no additional grains are formed.

12. A monodisperse, negative-working silver halide emulsion comprising silver chlorobromide or silver iodochlorobromide grains having a relatively high degree of crystal disorder and uniform habit wherein said crystal disorder measured by determining the Bragg angle for said grains and plotting $\beta \cos \theta$ vs $2 \sin \theta$, wherein $\beta$ is the breadth of the peak (at half-height) at Bragg angle $\theta$, provide a plot having a slope at least 2 times the slope plotted for a silver bromide grain wherein said emulsion is maintained at a temperature and in a chlorobromide environment as determined by the chloride content of said grains to prevent chloride loss from said grains.

13. The emulsion of claim 12 wherein said slope is at least 3 times the slope for a silver bromide grain.

14. The emulsion of claim 12 wherein the halide content of said grain comprises about 60–95% bromide; about 1–40% chloride and about 0–20% iodide.

15. The emulsion of claim 12 wherein said grains range from about 0.3–3.0 μm.

16. The emulsion of claim 12 wherein a dye image providing material is associated with said emulsion.

17. The emulsion of claim 16 wherein said dye image forming material is a dye developer.

* * * * *